US009707615B2

(12) United States Patent
Dick et al.

(10) Patent No.: US 9,707,615 B2
(45) Date of Patent: Jul. 18, 2017

(54) SHAPED METAL CONTAINER AND METHOD FOR MAKING SAME

(75) Inventors: Robert E. Dick, Cheswick, PA (US); Anthony J. Fedusa, Lower Burrell, PA (US); Gary L. Myers, Sarver, PA (US)

(73) Assignee: Alcoa USA Corp., Pittsburgh, PA (US)

( * ) Notice: Subject to any disclaimer, the term of this patent is extended or adjusted under 35 U.S.C. 154(b) by 0 days.

(21) Appl. No.: 13/214,676

(22) Filed: Aug. 22, 2011

(65) Prior Publication Data

US 2012/0043294 A1 Feb. 23, 2012

Related U.S. Application Data

(60) Provisional application No. 61/375,746, filed on Aug. 20, 2010.

(51) Int. Cl.
*B21D 51/26* (2006.01)
*B65D 1/02* (2006.01)

(52) U.S. Cl.
CPC ..... *B21D 51/2615* (2013.01); *B21D 51/2638* (2013.01); *B65D 1/023* (2013.01)

(58) Field of Classification Search
CPC .... B65D 1/023; B21D 22/28; B21D 51/2615; B21D 51/2638; B21D 51/38
USPC ..... 413/69, 76; 72/342.1, 347–349, 352, 72/353.4, 370.06, 370.13, 370.14, 72/370.23–370.25, 379.4, 393, 715
See application file for complete search history.

(56) References Cited

U.S. PATENT DOCUMENTS 3,029,507 A * 4/1962 Gaggini ..... 72/348
3,759,205 A 9/1973 Dolveck
3,857,917 A 12/1974 Reade
3,898,828 A 8/1975 Cassai et al.
3,995,572 A 12/1976 Saunders
4,163,380 A 8/1979 Masoner
4,173,883 A * 11/1979 Boik ..... 72/352
4,261,193 A * 4/1981 Boik ..... 72/349
4,947,667 A 8/1990 Gunkel et al.
5,040,682 A 8/1991 Palisin, Jr. et al.
5,058,408 A 10/1991 Leftault, Jr. et al.
(Continued)

FOREIGN PATENT DOCUMENTS

AU 2007254362 12/2010
CA 2655908 10/2011
(Continued)

OTHER PUBLICATIONS

"Aluminum Bottle Forming Simulation with Abaqus", by Kunming Mao (Dassault Suystemes Simulia Corp.) and Alejandro Santamaria (The Coca-Cola Company), 2009 Simulia Customer Conference, pp. 1-15.

(Continued)

*Primary Examiner* — David Bryant
*Assistant Examiner* — Pradeep C Battula
(74) *Attorney, Agent, or Firm* — Greenberg Traurig, LLP

(57) ABSTRACT

A shaped metal container having less metal than prior art shaped metal containers while still able to handle sufficient axial load and undergo shaping processes, including necking, without wrinkling, buckling, collapsing or other physical defect is disclosed. Processes for shaping a metal container having a sidewall of variable thickness, wherein a portion of the sidewall having a variable thickness is shaped using a die or dies are also disclosed.

9 Claims, 24 Drawing Sheets

(56) References Cited

U.S. PATENT DOCUMENTS

| | | | | |
|---|---|---|---|---|
| 5,095,730 | A * | 3/1992 | Lauder | B21D 37/01 72/347 |
| 5,160,031 | A | 11/1992 | Palisin, Jr. et al. | |
| 5,261,558 | A | 11/1993 | Claydon | |
| 5,351,852 | A | 10/1994 | Trageser et al. | |
| 5,355,710 | A * | 10/1994 | Diekhoff | 72/379.4 |
| 5,394,727 | A | 3/1995 | Diekhoff et al. | |
| 5,460,024 | A | 10/1995 | Meneghin et al. | |
| 5,470,405 | A | 11/1995 | Mair et al. | |
| 5,487,295 | A | 1/1996 | Diekhoff et al. | |
| 5,522,248 | A | 6/1996 | Diekhoff et al. | |
| 5,557,963 | A * | 9/1996 | Diekhoff | 72/379.4 |
| 5,572,893 | A | 11/1996 | Goda et al. | |
| 5,645,190 | A | 7/1997 | Goldberg | |
| 5,699,932 | A | 12/1997 | Claydon et al. | |
| 5,705,240 | A | 1/1998 | Machii et al. | |
| 5,711,178 | A * | 1/1998 | Hogendoorn et al. | 72/352 |
| 5,713,235 | A | 2/1998 | Diekhoff | |
| 5,724,848 | A * | 3/1998 | Aschberger | 72/356 |
| 5,727,414 | A | 3/1998 | Halasz et al. | |
| 5,746,080 | A | 5/1998 | Hartman et al. | |
| 5,755,130 | A | 5/1998 | Tung et al. | |
| 5,776,270 | A | 7/1998 | Biondich | |
| 5,822,843 | A | 10/1998 | Diekhoff et al. | |
| 5,832,766 | A | 11/1998 | Hartman et al. | |
| 5,851,685 | A | 12/1998 | McEldowney | |
| 5,899,104 | A | 5/1999 | Brilman et al. | |
| 5,899,105 | A | 5/1999 | Erhard | |
| 5,899,106 | A | 5/1999 | Heurteboust et al. | |
| 5,902,086 | A | 5/1999 | Enoki | |
| 5,916,317 | A | 6/1999 | Willoughby et al. | |
| 5,938,389 | A | 8/1999 | Shore et al. | |
| 5,960,659 | A | 10/1999 | Hartman et al. | |
| 5,970,767 | A | 10/1999 | Hartman et al. | |
| 6,038,910 | A | 3/2000 | McClung | |
| 6,079,244 | A | 6/2000 | Robinson et al. | |
| 6,085,563 | A | 7/2000 | Heiberger et al. | |
| 6,112,932 | A | 9/2000 | Holdren | |
| D435,454 | S | 12/2000 | Munn et al. | |
| 6,250,122 | B1 | 6/2001 | Robinson et al. | |
| 6,286,357 | B1 | 9/2001 | D'Amore et al. | |
| 6,308,545 | B2 | 10/2001 | Burgel et al. | |
| 6,338,263 | B1 | 1/2002 | Obata et al. | |
| 6,343,496 | B1 | 2/2002 | Hanna et al. | |
| D455,961 | S | 4/2002 | Edson et al. | |
| 6,374,657 | B1 | 4/2002 | Kirk et al. | |
| 6,442,991 | B1 | 9/2002 | Rojek | |
| D464,264 | S | 10/2002 | Edson et al. | |
| 6,655,181 | B2 | 12/2003 | Morales | |
| 6,701,764 | B2 | 3/2004 | Bruck et al. | |
| D490,317 | S | 5/2004 | Chang | |
| 6,779,677 | B2 | 8/2004 | Chupak | |
| 6,802,196 | B2 | 10/2004 | Gong et al. | |
| 6,886,722 | B2 | 5/2005 | Flecheux | |
| 6,907,653 | B2 | 6/2005 | Chupak | |
| 6,945,085 | B1 | 9/2005 | Goda | |
| D512,315 | S | 12/2005 | Holm | |
| D514,937 | S | 2/2006 | Chang | |
| 7,003,999 | B2 | 2/2006 | Campo et al. | |
| 7,004,000 | B2 | 2/2006 | Campo et al. | |
| 7,140,223 | B2 * | 11/2006 | Chupak | 72/356 |
| 7,188,499 | B2 | 3/2007 | Ogaki et al. | |
| 7,670,094 | B2 | 3/2010 | Boltshauser | |
| 7,726,165 | B2 * | 6/2010 | Myers et al. | 72/348 |
| 7,845,204 | B2 * | 12/2010 | Smyers et al. | 72/349 |
| 7,934,410 | B2 * | 5/2011 | Myers et al. | 72/348 |
| 7,954,354 | B2 * | 6/2011 | Myers et al. | 72/379.4 |
| 8,132,687 | B2 * | 3/2012 | Fedusa et al. | 220/62.18 |
| 8,322,183 | B2 * | 12/2012 | Myers et al. | 72/348 |
| 8,365,570 | B2 * | 2/2013 | Kubo et al. | 72/348 |
| 8,413,478 | B2 * | 4/2013 | Tomaru et al. | 72/349 |
| 8,555,692 | B2 | 10/2013 | Myers et al. | |
| 2001/0022103 | A1 | 9/2001 | Zeiter et al. | |
| 2001/0040167 | A1 | 11/2001 | Flecheux et al. | |
| 2002/0162371 | A1 | 11/2002 | Hamstra et al. | |
| 2003/0074946 | A1 | 4/2003 | Campo et al. | |
| 2003/0102278 | A1 | 6/2003 | Chupak | |
| 2003/0115923 | A1 | 6/2003 | Veen et al. | |
| 2004/0011112 | A1 | 1/2004 | Lentz et al. | |
| 2004/0035871 | A1 * | 2/2004 | Chupak | 220/608 |
| 2004/0040970 | A1 | 3/2004 | Weijers et al. | |
| 2004/0187536 | A1 | 9/2004 | Gong et al. | |
| 2004/0194522 | A1 | 10/2004 | Hamstra et al. | |
| 2004/0216506 | A1 | 11/2004 | Simpson et al. | |
| 2004/0231395 | A1 | 11/2004 | Barber | |
| 2005/0000260 | A1 | 1/2005 | Campo et al. | |
| 2005/0193796 | A1 | 9/2005 | Heiberger et al. | |
| 2005/0235726 | A1 | 10/2005 | Chupak | |
| 2006/0071035 | A1 | 4/2006 | Christ et al. | |
| 2007/0266758 | A1 * | 11/2007 | Myers et al. | 72/379.4 |
| 2007/0271993 | A1 | 11/2007 | Druesne et al. | |
| 2008/0022746 | A1 * | 1/2008 | Myers et al. | 72/273 |
| 2008/0116212 | A1 | 5/2008 | Jonker | |
| 2009/0274957 | A1 | 11/2009 | Goda et al. | |
| 2011/0167886 | A1 | 7/2011 | Mallory et al. | |
| 2011/0167889 | A1 | 7/2011 | Myers et al. | |

FOREIGN PATENT DOCUMENTS

| | | |
|---|---|---|
| CL | 223496 | 12/1996 |
| DE | 4113428 | 10/1992 |
| EP | 492861 | 7/1992 |
| EP | 599583 | 6/1994 |
| EP | 721384 | 8/1994 |
| EP | 767241 | 4/1997 |
| EP | 845315 | 6/1998 |
| EP | 852973 | 7/1998 |
| EP | 852974 | 7/1998 |
| EP | 854823 | 7/1998 |
| EP | 0876872 | 11/1998 |
| EP | 1064413 | 1/2001 |
| EP | 0750953 | 3/2001 |
| EP | 853513 | 8/2001 |
| EP | 928229 | 8/2001 |
| EP | 853514 | 10/2001 |
| EP | 853515 | 10/2001 |
| EP | 1294622 | 3/2003 |
| EP | 1506824 | 2/2005 |
| EP | 1461262 | 2/2007 |
| EP | 1586393 | 9/2007 |
| EP | 2111935 | 10/2009 |
| FR | 2495507 | 6/1982 |
| JP | 63-183738 | 7/1988 |
| JP | 02-104430 | 4/1990 |
| JP | 06-238818 | 8/1994 |
| JP | 7185707 | 7/1995 |
| JP | 7242226 | 9/1995 |
| JP | 2000015371 | 1/2000 |
| JP | 2001-179375 | 7/2001 |
| WO | 9111274 | 8/1991 |
| WO | 9111275 | 8/1991 |
| WO | 9114626 | 10/1991 |
| WO | 9505253 | 2/1995 |
| WO | 9515227 | 6/1995 |
| WO | 9615865 | 5/1996 |
| WO | 9625256 | 8/1996 |
| WO | 9640457 | 12/1996 |
| WO | 9711889 | 4/1997 |
| WO | 9712704 | 4/1997 |
| WO | 9712705 | 4/1997 |
| WO | 9712706 | 4/1997 |
| WO | 9747408 | 12/1997 |
| WO | 9805445 | 2/1998 |
| WO | 9839117 | 9/1998 |
| WO | 9843757 | 10/1998 |
| WO | 9932242 | 7/1999 |
| WO | 9937826 | 7/1999 |
| WO | 0151231 | 7/2001 |
| WO | 0158618 | 8/2001 |
| WO | 0196209 | 12/2001 |
| WO | 03047991 | 6/2003 |
| WO | 2004058597 | 7/2004 |
| WO | 2005000498 | 1/2005 |
| WO | 2005099926 | 10/2005 |

(56) References Cited

FOREIGN PATENT DOCUMENTS

| | | |
|---|---|---|
| WO | 2006/033376 | 3/2006 |
| WO | 2006040116 | 4/2006 |
| WO | 2006078690 | 7/2006 |
| WO | WO 2008/002899 | 1/2008 |
| WO | 2008110679 | 9/2008 |
| WO | 2009130034 | 10/2009 |

OTHER PUBLICATIONS

International Search Report and Written Opinion of the International Searching Authority from PCT application No. PCT/US2011/048603 mailed on Feb. 20, 2012.

* cited by examiner

SHAPED METAL CONTAINER AND METHOD FOR MAKING SAME

CROSS-REFERENCE TO RELATED APPLICATION

This application claims priority to U.S. Provisional Patent Application No. 61/375,746, entitled "Shaped Aluminum Container and Method for Making Same," filed on Aug. 20, 2010, which is incorporated herein by reference in its entirety.

FIELD OF THE INVENTION

This invention relates to metal containers and the methods for making metal containers.

BACKGROUND

In the metal container industry, substantially identically shaped beverage containers are produced massively. Dies have been used to neck the tops of the containers.

SUMMARY

In some embodiments, a shaped aluminum container has a sidewall comprising a top necked portion and a bottom necked portion. In some embodiments, the thickness of the sidewall in the bottom necked portions varies by at least 0.001 inches. In some embodiments, the thickness of the sidewall in the top necked portions varies by at least 0.001 inches. In other embodiments, the sidewall thickness in either the top or bottom portions, or both vary by at least 0.0015" or 0.002". In some embodiments, the sidewall thickness varies by no more than 0.0015", 0.002", 0.0025, 0.003" or 0.004".

In some embodiments, the shaped aluminum container is manufactured by a process comprising: necking a lower portion of the sidewall with a first necking die so that a working surface of the first necking die contacts a first section of the sidewall and reduces a diameter of the first section of the sidewall by at least 3% in a single die stroke, wherein the thickness of the first section of the sidewall varies along the height of the sidewall by at least 0.001 inches; and necking an upper portion of the sidewall with a second necking die so that a working surface of the second necking die contacts a second section of the sidewall and reduces a diameter of the second section of the sidewall by at least 2% in a single stroke. In some embodiments, the thickness of the second section of the sidewall varies along the height of the sidewall by at least 0.001 inches. In other embodiments, the sidewall thickness in either the top or bottom portions, or both vary by at least 0.0015" or 0.002". In some embodiments, the sidewall thickness varies by no more than 0.0015", 0.002", 0.003" or 0.004". In some embodiments, the lower portion and/or the upper portion is necked with a series of necking dies. A series of necking dies may comprise two or more necking dies. In one embodiment, the lower portion is necked with two necking dies. In one embodiment the first die to neck the lower portion reduces the diameter of the container by about 6% and the second die to neck the lower portion of the container reduces the diameter of the container an additional 4% of the original diameter. In some embodiments, a single necking die may reduce the diameter of the container 2%, 3%, 4%, 5%, 9%, 12% or more.

In some embodiments, the process further comprises expanding the diameter of a middle portion of the sidewall before necking the upper portion of the sidewall. In some embodiments, a thickness of the middle portion varies by at least 0.001 inches. In some embodiments, the thickest portion is at or near the top of the container. In some embodiments, the thinnest or a thin portion can be at or near the top of the container.

In some embodiments, the first and the second necking dies are configured for use on metal bottle stock and comprise a necking surface and a relief. The necking surface comprises a land portion, a neck radius portion, and a shoulder radius portion, each having an inner diameter. The land portion is between the neck radius portion and the relief. The inner diameter of the land is a minimum diameter of the die. The inner diameters of the neck radius portion and the shoulder radius portion are greater than the inner diameter of the land. The relief comprises a relief surface, wherein an inner diameter of the relief surface is at least about 0.01 inches greater than the inner diameter of the land portion and an inner diameter of the relief surface is no greater than a maximum diameter so as to reduce but not eliminate frictional contact between the sidewall and the relief surface while maintaining necking performance when necking the sidewall. In some embodiments, the diameter of the relief surface is about 0.0075 to about 0.035 inches greater than the inner diameter of the land portion. In other embodiments, the diameter of the relief surface is about 0.01, 0.02 or 0.03 inches greater than the inner diameter of the land portion. In some embodiments, the length of the land portion is between about 0.02" to about 0.08". In other embodiments, the length of the land is about 0.03" to about 0.07". In yet other embodiments, the length of the land portion is between about 0.04" to about 0.06". In one embodiment, the length of the land portion is about 0.04". In some embodiments, the necking die is dimensioned so that when necking the metal bottle stock, the entire land and the relief travel relative to the sidewall in an axial direction and at least a portion of the relief travels beyond a top of the sidewall.

In some embodiments, the land has a surface finish Ra ranging from about 8 μin to about 32 μin. In some embodiments, the relief has a surface finish Ra ranging from about 8 μin to about 32 μin, from about 2 μin to about 6 μin or from about 2 μin to about 32 μin. In some embodiments, the neck radius portion and the shoulder radius portion have a surface finish Ra ranging from about 2 μin to about 6 μin.

In some embodiments, an expansion die for manufacturing metal containers expands the diameter of the middle portion of the sidewall. The expansion die for manufacturing metal containers comprises a working surface and an undercut portion, wherein the working surface is configured to expand a diameter of a metal container having a closed bottom. The work surface comprises a progressively expanding portion and a land portion. The land portion is between the progressively expanding portion and the undercut portion. The outer diameter of the land portion is a maximum diameter of the die. In some embodiments, the length of the land portion is a minimum 0.12". In some embodiments, the length of the land portion is between about 0.01" to about 0.12". In some embodiments, the length of the land portion is between about 0.02" to about 0.08". In other embodiments, the length of the land is about 0.03" to about 0.07". In yet other embodiments, the length of the land portion is between about 0.04" to about 0.06". In one embodiment, the length of the land portion is about 0.04". The undercut portion comprises an undercut surface having an outer diameter. The outer diameter of the undercut surface is at least approximately 0.01 inches smaller than the outer diameter of the land portion and no less than a minimum diameter so as to reduce but not eliminate frictional contact between the undercut surface and the metal container. The outer diameter of the undercut surface is dimensioned to minimize collapse, fracture, wrinkle and all other physical defects, which may occur during expansion. The work surface is dimensioned so that when inserted into the aluminum container the entire land portion and at least a portion of the undercut portion enter the aluminum container causing the diameter of the middle portion of the sidewall to expand.

In some embodiments, an initial portion of the work surface of the expansion die has a geometry for forming a transition in a container from an original diameter portion to an expanded diameter portion. In some embodiments, the transition is stepped or gradual. In some embodiments, the land portion of the expansion die has dimensions to provide an expanded diameter of a container stock worked by the work surface.

In some embodiments, at least a portion of the work surface of the expansion die has a surface roughness average (Ra) of approximately 8 μin to 32 μin. In some embodiments, at least a portion of the undercut portion has surface roughness average (Ra) of approximately 8 μin to 32 μin. In some embodiments, the outer diameter of the land portion of the expansion die is substantially constant along the length of the land.

In some embodiments, the diameter of the middle portion of the sidewall is expanded with a series of expansion dies.

In some embodiments, the top of the container is dimensioned to accept a closure. In some embodiments, a closure covers an opening on top of the container. In some embodiments, the closure comprises one of: a lug, a crown, a roll-on pilfer proof closure or a threaded closure.

In some embodiments, a can end having a severable pour spout encloses a top of the container.

A process for forming a metal container comprises: providing a container having a sidewall, wherein the sidewall has a thickness and a height, and wherein the thickness varies along the height of the sidewall by at least 0.0010 inches; and necking the container with a necking die so that a working surface of the necking die contacts a section of the sidewall and reduces a diameter of the section of the sidewall by at least 2% in a single stroke, wherein the thickness of the section of the sidewall varies along the height of the sidewall by at least 0.0010 inches before and after necking.

In some embodiments, the necking die used in the process of forming a metal container comprises: a necking surface and a relief; wherein the necking surface comprises a land portion, a neck radius portion, and a shoulder radius portion, each having an inner diameter; wherein the land portion is between the neck radius portion and the relief and the inner diameter of the land is a minimum diameter of the die; wherein the inner diameters of the neck radius portion and the shoulder radius portion are greater than the inner diameter of the land; wherein the relief comprises: (a) a relief surface; (b) an inner diameter of the relief surface is at least about 0.01 inches greater than the inner diameter of the land portion; (c) an inner diameter of the relief surface is no greater than a maximum diameter so as to reduce but not eliminate frictional contact between the metal container and the relief surface while maintaining necking performance when necking the metal container; and wherein the necking die is dimensioned so that when necking the metal container, the entire land and the relief travel relative to the container in an axial direction and at least a portion of the relief travels beyond a top of the container.

In some embodiments, the process of forming a metal container further comprises expanding the diameter of a portion of the sidewall.

In some embodiments, the process of forming a metal container further comprises necking the container with a series of necking dies.

In some embodiments, the process of forming a metal container further comprises expanding the diameter of the portion of the sidewall with a series of expansion dies.

In some embodiments, at least one of the expansion dies comprises: a work surface comprising a progressively expanding portion and a land portion; and an undercut portion; wherein the land portion is between the progressively expanding portion and the undercut portion and an outer diameter of the land portion is a maximum diameter of the die; wherein the undercut portion comprises: (a) an undercut surface; and (b) an outer diameter of the undercut surface, wherein the outer diameter of the undercut surface is: (i) at least approximately 0.01 inches smaller than the outer diameter of the land portion; and (ii) no less than a minimum diameter so as to reduce but not eliminate frictional contact between the undercut surface and the aluminum container; and wherein the work surface is dimensioned so that when inserted into the metal container the entire land portion and at least a portion of the undercut portion enter the metal container causing the diameter of the at least a portion of the sidewall to expand.

In some embodiments, a process for forming a metal container comprises: providing a container having a sidewall, wherein the sidewall has a thickness and a height, and wherein the thickness varies along the height of the sidewall by at least 0.001 inches; and expanding the diameter of the container with an expansion die so that a working surface of the expansion die contacts a section of the sidewall and expands a diameter of the section of the sidewall by at least 2% in a single stroke, wherein the thickness of the section of the sidewall varies along the height of the sidewall by at least 0.001 inches before and after expanding. In some embodiments, the process further comprises necking the container. In some embodiments, the process further comprises expanding the diameter of the container with a series of expansion dies. In some embodiments, the expansion die comprises: a work surface comprising a progressively expanding portion and a land portion; and an undercut portion; wherein the land portion is between the progressively expanding portion and the undercut portion and an outer diameter of the land portion is a maximum diameter of the die; wherein the undercut portion comprises: (a) an undercut surface; and (b) an outer diameter of the undercut surface, wherein the outer diameter of the undercut surface is: (i) at least approximately 0.01 inches smaller than the outer diameter of the land portion; and (ii) no less than a minimum diameter so as to reduce but not eliminate frictional contact between the undercut surface and the aluminum container; and wherein the work surface is dimensioned so that when inserted into the metal container the entire land portion and at least a portion of the undercut portion enter the metal container causing the diameter of the at least a portion of the sidewall to expand.

BRIEF DESCRIPTION OF THE DRAWINGS

The following detailed description, given by way of example and not intended to limit the invention solely thereto, will best be appreciated in conjunction with the accompanying drawings, wherein like reference numerals denote like elements and parts, in which.

DESCRIPTION

For the purposes of this specification, terms such as top, bottom, below, above, under, over, etc. are relative to the position of a finished metal container resting on a flat surface, regardless of the orientation of the metal container during manufacturing or forming steps or processes. A finished metal container is a metal container that will not undergo additional forming steps before it is used by an end consumer. In some embodiments, the top of the container has an opening.

The term "bottle stock" is used throughout this specification. However, all of the processes, products and apparatuses disclosed herein are applicable to all metal containers including beverage cans and cups, aerosol cans and food containers. A quotation mark or "in" designates inches.

Figure 1:
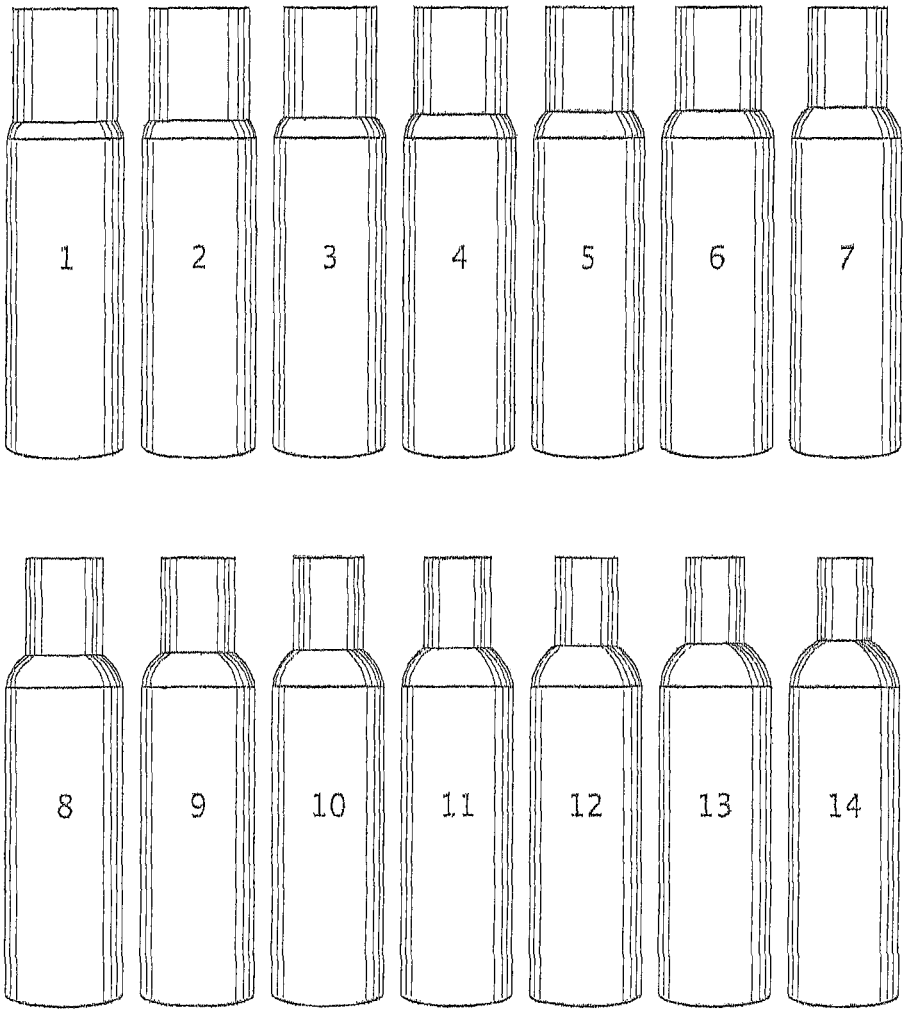
FIG. 1 PRIOR ART
FIG. 1 is a pictorial representation of a 14 stage die necking progression for a 53 mm diameter can body in accordance with the present invention.

FIG. 1 depicts a bottle stock after each stage of necking by a necking system in accordance with the one embodiment present invention, in which the inventive necking system provides for a more aggressive necking reduction scheme than was previously available with prior necking systems and the ability to neck a container through thick wall and thin wall portions, i.e. containers having sidewalls that vary in thickness by at least 0.001 inches and the necking die travels past the thick wall portion and into the thin wall portion in a single stroke. FIG. 1 depicts the progression of necking from an initial necking die to produce the first necked bottle stock 1 to a final necking die to produce the final necked bottle stock 14. Although FIG. 1 depicts a necking system including 14 stages, the following disclosure is not intended to be limited thereto, since the number of necking stages may vary depending on the material of the bottle stock, the bottle stock's sidewall thickness(es), the initial diameter of the bottle stock, the final diameter of the bottle, the required shape of the neck profile, and the necking force. Therefore, any number of necking dies has been contemplated and is within the scope of the present invention, so long as the progression provides for necking without collapse or other physical defect of the bottle stock.

Figure 2:
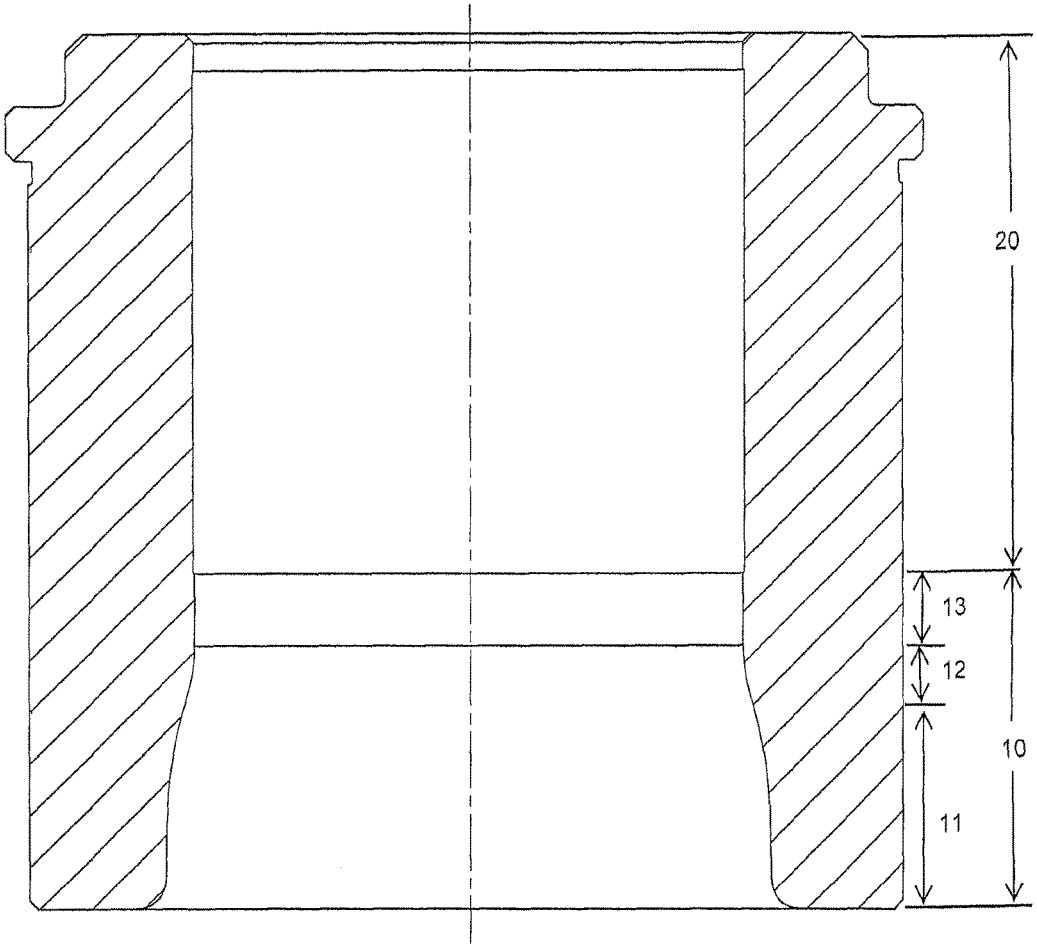
FIG. 2 PRIOR ART
FIG. 2 represents a cross-sectional side view of one embodiment of an initial necking die in accordance with the present invention.

FIG. 2 depicts a cross sectional view of a necking die including at least a partially textured necking surface 10 and a textured relief 20 following the necking surface 10. In one embodiment, the partially textured necking surface 10 includes a shoulder or body radius portion 11, a neck radius portion 12, and a land portion 13.

In some embodiments, a necking die includes a partially textured necking surface 10, which reduces surface contact between the necking surface and the bottle stock being necked in a manner that reduces the force that is required to neck the bottle (hereafter referred to as "necking force"). It has unexpectedly been determined that a necking surface having a textured surface provides less resistance to a bottle stock being necked than a non-textured surface. As opposed to the prior expectation that a smooth, non-textured, highly polished surface would provide less resistance and hence require less necking force, it has been determined that a surface with a relatively low Ra value, i.e. <~6 micro inches has greater surface contact with the bottle being necked resulting in greater resistance and requiring greater necking force. In some embodiments of the present invention, the increased surface roughness (higher Ra value) reduces the surface contact between the necking surface and the bottle being necked, hence reducing the required necking force.

Reducing the necking force required to neck the bottle stock allows for necking dies having a greater percent reduction than previously available in prior necking dies. It also helps to enable the die to neck through varying thicknesses of metal sidewall.

Figure 3:
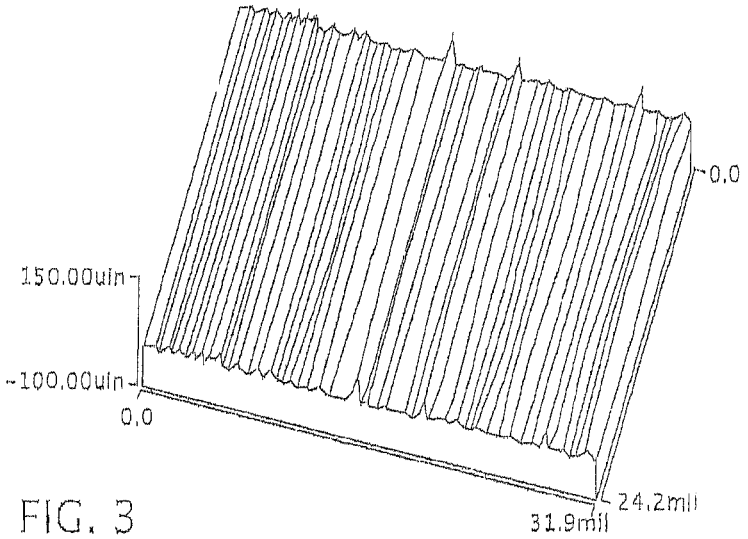
FIG. 3 represents a surface mapping of one embodiment of a polished necking surface, in accordance with the present invention.
Figure 4:
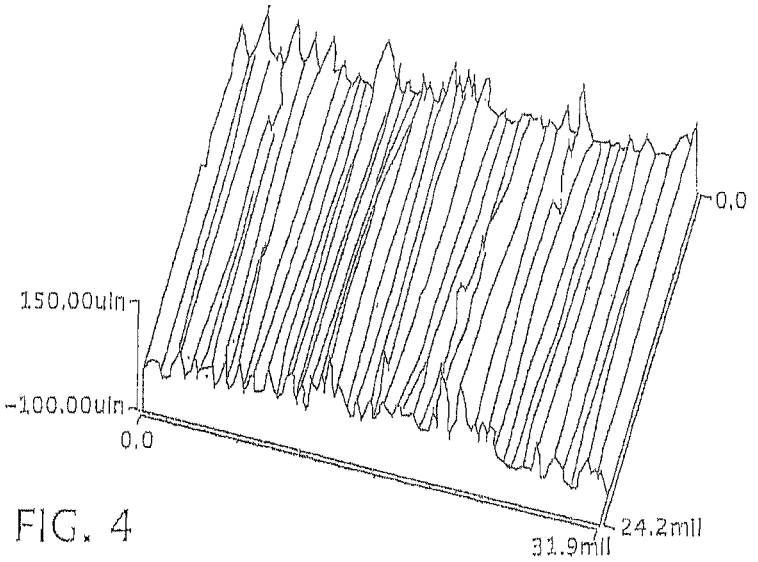
FIG. 4 PRIOR ART
FIG. 4 represents a surface mapping of one embodiment of a non-polished necking surface, in accordance with the present invention.

In one embodiment, a textured surface has a surface roughness average (Ra) ranging from more than or equal to 8 μin to less than or equal to 32 μin, so long as the textured necking surface does not disadvantageously disrupt the aesthetic features of the bottle stock's surface (coating) finish in a significantly observable manner. In one embodiment, a non-textured surface has a surface roughness average (Ra) finish ranging from 2 μin to 6 μin. FIG. 3 represents a surface mapping of one embodiment of a non-textured land portion 13 of the necking die generated by ADE/Phase Shift Analysis and MapVue EX-Surface Mapping Software. In this example, the surface roughness (Ra) value was approximately 4.89 μin. FIG. 4 represents a surface mapping of one embodiment of a textured land portion 13 of the necking die, in accordance with an embodiment of the present invention generated by ADE/Phase Shift Analysis and MapVue EX-Surface Mapping Software. In this example, the surface roughness (Ra) value was approximately 25.7 μin.

Figure 2A:
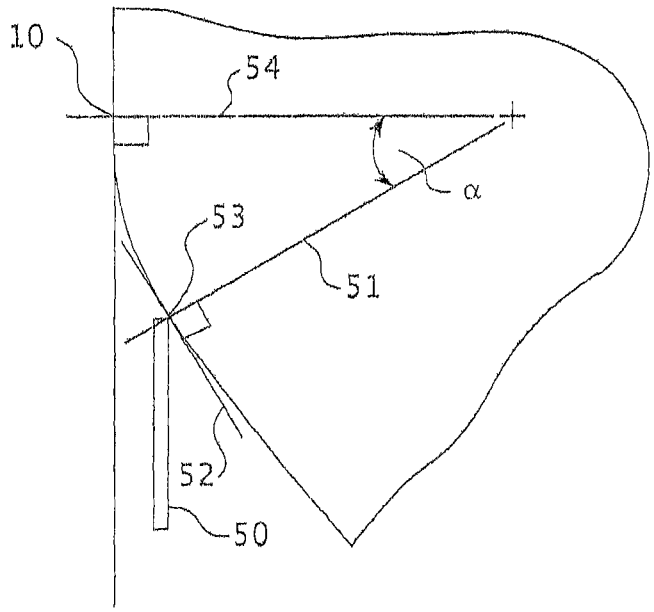
FIG. 2(a) PRIOR ART
FIG. 2*a* represents a magnified view of the contact angle depicted in FIG. 2, wherein the contact angle is measured from where the bottle stock contacts the necking surface.

Referring to FIG. 2, in one embodiment, the partially textured necking surface 10 includes a textured land portion 13, a non-textured neck radius portion 12, and a non-textured shoulder radius portion 11. In another embodiment, the at least partially textured necking surface 10 may be entirely textured. Referring to FIG. 2*a*, the contact angle α of the bottle stock 50 to the necking surface 10 may be less than 32°, wherein the contact angle is the included angle between 54 (the ray extending perpendicular to the land) and 51 (the ray extending perpendicular from the plane tangent to the point of contact by the bottle stock with the necking surface). In some embodiments, the working surface and/or relief may be entirely non-textured. In some embodiments, the working surface and/or relief is hard turned and lightly polished to knock off rough edges to obtain a surface finish of about 8-10 micro inches, or about 8-16 micro inches or about 8 to 32 micro inches.

The textured land portion 13 in FIG. 2 in conjunction with the knockout (not shown) provide a working surface for forming an upper portion of the bottle stock into a bottle neck during necking. The knockout (not shown) fits inside the container or bottle stock during necking and helps the container to be removed from the die after necking. In one embodiment, the textured land 13 extends from tangent point of neck radius portion 12 of the die wall parallel to the center line of the necking die. The textured land portion 13 may extend along the necking direction (along the y-axis) by a distance Y1 being less than 0.5", or being on the order of approximately 0.0625". In some embodiments, the length of the land portion is between about 0.02" to about 0.08". In some embodiments, the length of the land portion is between about 0.03" to about 0.07". In some embodiments, the length of the land portion is between about 0.04" to about 0.06". In some embodiments, the length of the land portion is approximately 0.04".

Another aspect of some embodiments of the present invention is a relief 20 positioned in the necking die wall following the necking surface 10. The dimensions of the relief 20 are provided to reduce, but not eliminate, frictional contact with the bottle stock and the necking die, once the bottle stock has been necked through the land 13 and knockout. Therefore, in some embodiments, the relief 20, in conjunction with the partially textured necking surface 10, contributes to the reduction of frictional contact between the necking die wall and the bottle stock being necked, wherein the reduced frictional contact maintains necking performance while reducing the incidence of collapse, buckling, rupturing, wrinkling and other physical defects, and improving stripping of the bottle stock.

In one embodiment, the relief 20 extends into the necking die wall by a dimension X2 of at least 0.005 inches measured from the base 13*a* of the land 13, in other embodiments, at least 0.010 inches or 0.015 inches. In some embodiments, the relief extends into the die wall no more than 0.025". The relief 20 may extend along the necking direction (along the y-axis) the entire length of the top portion of the bottle stock that enters the necking die to reduce, but not eliminate, the frictional engagement between the bottle stock and the necking die wall to reduce the incidence of collapse, buckling, rupturing, wrinkling and other physical defects, yet maintain necking performance. In one embodiment, the relief 20 is a textured surface. The transition from the land to the relief is blended, with no sharp corners, so that the metal bottle stock can travel over the land in either direction without being damaged.

In some embodiments of the present invention, a necking system is provided in which at least one of the necking dies of the systems may provide an aggressive reduction in the bottle stock diameter. Although FIG. 2 represents an introductory die, the above discussion regarding the shoulder radius 11, neck radius 12, land 13 and relief 20 is equally applicable and may be present in each necking die of the necking system. The geometry of the necking surface of at least one of the successive dies provides for increasing reduction, wherein the term "reduction" corresponds to decreasing the bottle stock diameter from the bottle stock's initial diameter to a final diameter.

In one embodiment, the introductory die reduced the diameter of the container being necked by more than 5% in a single necking stroke, or more than 9% in a single necking stroke. The level of reduction that is achievable by the dies of the necking system is partially dependent on the surface finish of the necking surface, necking force, bottle stock material, required neck profile, and sidewall thickness(es). In one embodiment, an introductory necking die provides a reduction of greater than 9%, wherein the initial necking die is configured for producing an aluminum bottle necked package from an aluminum sheet composed of an Aluminum Association 3104 alloy, having an upper sidewall thickness of about 0.0085 inch or less and a post bake yield strength ranging from about 34 to 37 ksi. In some embodiments, the upper sidewall thickness may be 0.0085, 0.0080, 0.0075, 0.0070, 0.0060, 0.0050 inches, just to name a few examples. In some embodiments, the thickness of the sidewall in the bottom necked portions varies by at least 0.0010 inches. In some embodiments, the thickness of the sidewall in the top necked portions varies by at least 0.0010 inches. In other embodiments, the sidewall thickness in either the top or bottom portions, or both vary by at least 0.0015" or 0.002" In some embodiments, the sidewall thickness varies by no more than 0.0015", 0.002", 0.0025, 0.003" or 0.004".

Figure 5:
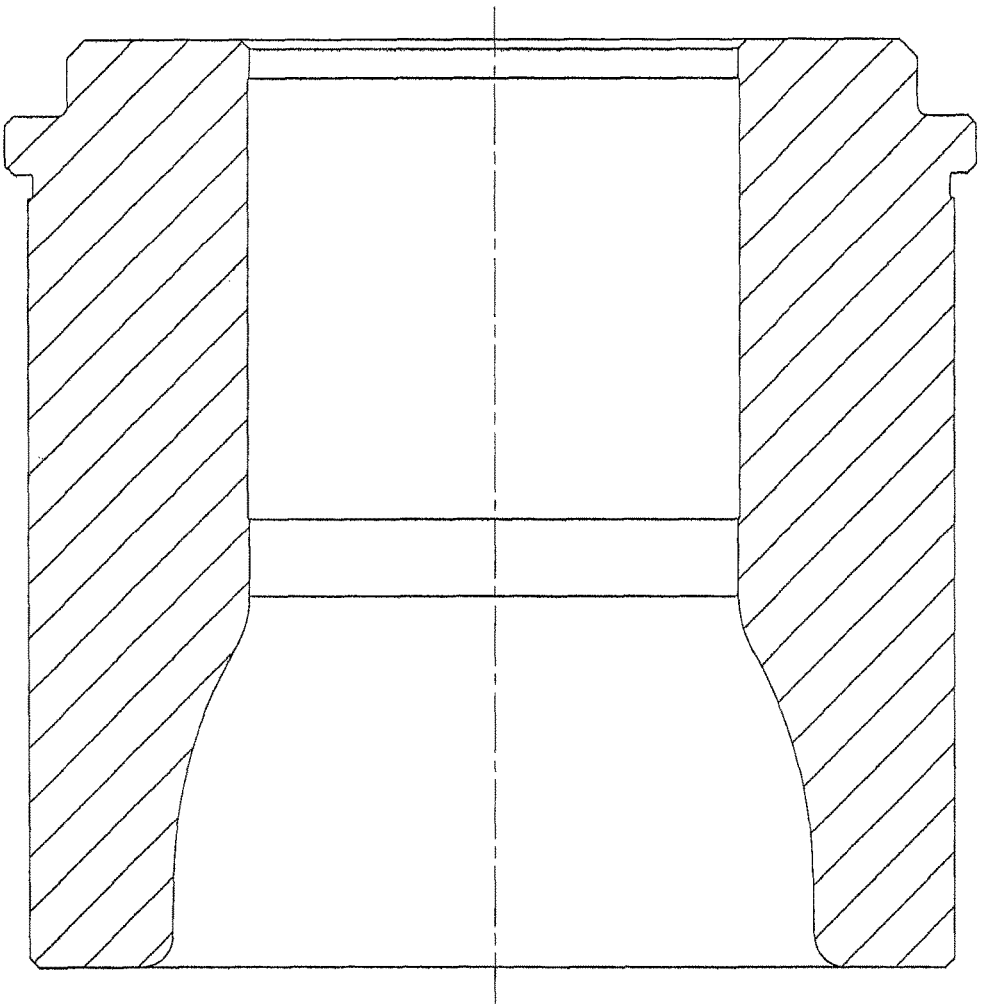
FIG. 5 PRIOR ART
FIG. 5 shows a cross-sectional side view of one embodiment of an intermediate necking die in accordance with the present invention.

FIG. 5 depicts one embodiment of an intermediate die in accordance with the present invention, in which the intermediate necking die may be employed once the bottle stock has been necked with an initial necking die. In comparison to the introductory necking die depicted in FIG. 2, the intermediate necking die depicted in FIG. 5 provides a less aggressive reduction. In one embodiment, a plurality of intermediate necking dies each provide a reduction ranging from 4% to 7%. The number of intermediate necking dies depends on the bottle stock initial diameter, required final diameter, neck profile, sidewall thickness and variability of the thickness of the sidewall.

Figure 6:
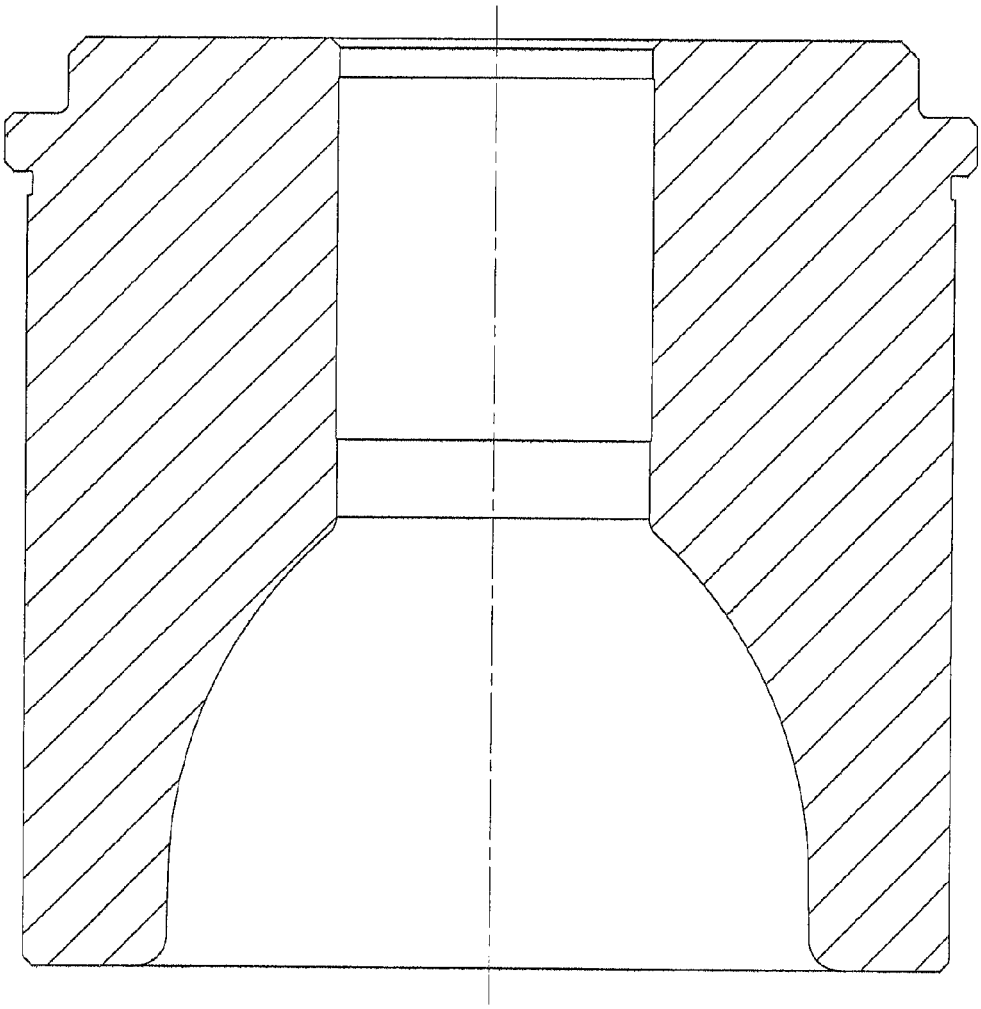
FIG. 6 PRIOR ART
FIG. 6 illustrates a cross-sectional side view of one embodiment of a final necking die in accordance with the present invention.

FIG. 6 depicts one embodiment of a final necking die in accordance with the present invention. The final necking die is utilized once the bottle stock has been necked by the intermediate necking dies. The final necking die has a necking surface that results in the neck dimension of the finished product. In one embodiment, the final necking die provides a reduction of less than 4%. In one embodiment, the final necking die may have a reduction of 1.9%.

In one embodiment, a necking system is provided in which the plurality of necking dies include an introductory necking die having a reduction greater than 9%, 12 intermediate dies having a reduction ranging from 4.1 to 6.1%, and a final necking die having a reduction of 1.9%.

In one embodiment of the present invention, a method of necking metal containers, utilizing a necking system as described above, is provided including the steps of providing an aluminum blank, such as a disc or a slug; shaping the blank into an aluminum bottle stock; and necking the aluminum bottle stock, wherein necking comprises at least one necking die having an at least partially textured necking surface.

Some embodiments of the present invention provide a necking system including a reduced number of dies and knockouts, therefore advantageously reducing the machine cost associated with tooling for necking operations in bottle manufacturing.

By reducing the number of necking die stages, the present invention advantageously reduces the time associated with necking in bottle manufacturing.

Although the invention has been described generally above, the following examples are provided to further illustrate the present invention and demonstrate some advantages that arise therefrom. It is not intended that the invention be limited to the specific examples disclosed.

EXAMPLE

Table 1 below shows the reduction provided by a 14 stage die necking schedule, in which the necking die geometry was configured to form an aluminum bottle necked package from an aluminum bottle stock having a upper sidewall sheet thickness of approximately 0.0085 inch and a post bake yield strength ranging from about 34 to 37 Ksi. The aluminum composition is Aluminum Association (AA) 3104. As indicated by Table 1, the bottle stock is necked from an initial diameter of approximately 2,0870" to a final diameter of 1.025" without failure, such as wall collapse.

TABLE 1

53 mm Diameter Bottle Stock
14-Stage Die Necking Schedule

| Station Number | Necking Die Entry Diameter (in) | Starting Bottle Stock Diam (in) | Reduction (in) | Final Can Diameter (in) | Percent Reduction (in) | Body Radius (in) | Neck Radius (in) | Neck Angle (degrees) | Knockout Diameter (in) | Contact Angle (degrees) |
|---|---|---|---|---|---|---|---|---|---|---|
| 1 | 2.0900 | 2.0870 | 0.187 | 1.9000 | 8.960 | 1.500 | 0.590 | 72.659 | 1.8798 | 0.000 |
| 2 | 2.0900 | 1.9000 | 0.080 | 1.8200 | 4.211 | 1.500 | 0.500 | 68.828 | 1.8000 | 23.074 |
| 3 | 2.0900 | 1.8200 | 0.075 | 1.7450 | 4.121 | 1.500 | 0.450 | 65.719 | 1.7243 | 23.556 |
| 4 | 2.0900 | 1.7450 | 0.075 | 1.6700 | 4.298 | 1.500 | 0.400 | 62.807 | 1.6495 | 25.008 |
| 5 | 2.0900 | 1.6700 | 0.075 | 1.5950 | 4.491 | 1.500 | 0.350 | 60.022 | 1.5735 | 26.766 |
| 6 | 2.0900 | 1.5950 | 0.075 | 1.5200 | 4.702 | 1.500 | 0.300 | 67.317 | 1.4980 | 28.955 |
| 7 | 2.0900 | 1.5200 | 0.075 | 1.4450 | 4.934 | 1.500 | 0.250 | 54.658 | 1.4223 | 31.788 |
| 8 | 2.0900 | 1.4450 | 0.075 | 1.3700 | 5.190 | 1.500 | 0.250 | 52.588 | 1.3464 | 31.788 |
| 9 | 2.0900 | 1.3700 | 0.075 | 1.2950 | 5.474 | 1.500 | 0.250 | 50.611 | 1.2706 | 31.788 |
| 10 | 2.0900 | 1.2950 | 0.075 | 1.2200 | 5.792 | 1.500 | 0.250 | 48.714 | 1.1944 | 31.788 |
| 11 | 2.0900 | 1.2200 | 0.075 | 1.1450 | 6.148 | 1.500 | 0.250 | 46.886 | 1.1185 | 31.788 |
| 12 | 2.0900 | 1.1450 | 0.050 | 1.0950 | 4.367 | 1.500 | 0.200 | 45.020 | 1.0675 | 28.955 |
| 13 | 2.0900 | 1.0950 | 0.050 | 1.0450 | 4.566 | 1.500 | 0.175 | 43.477 | 1.0164 | 31.003 |
| 14 | 2.0900 | 1.0450 | 0.020 | 1.0250 | 1.914 | 1.500 | 0.070 | 41.363 | 0.9955 | 31.003 |
| | | 1.0250 | | | | | | | | |

Figure 7:
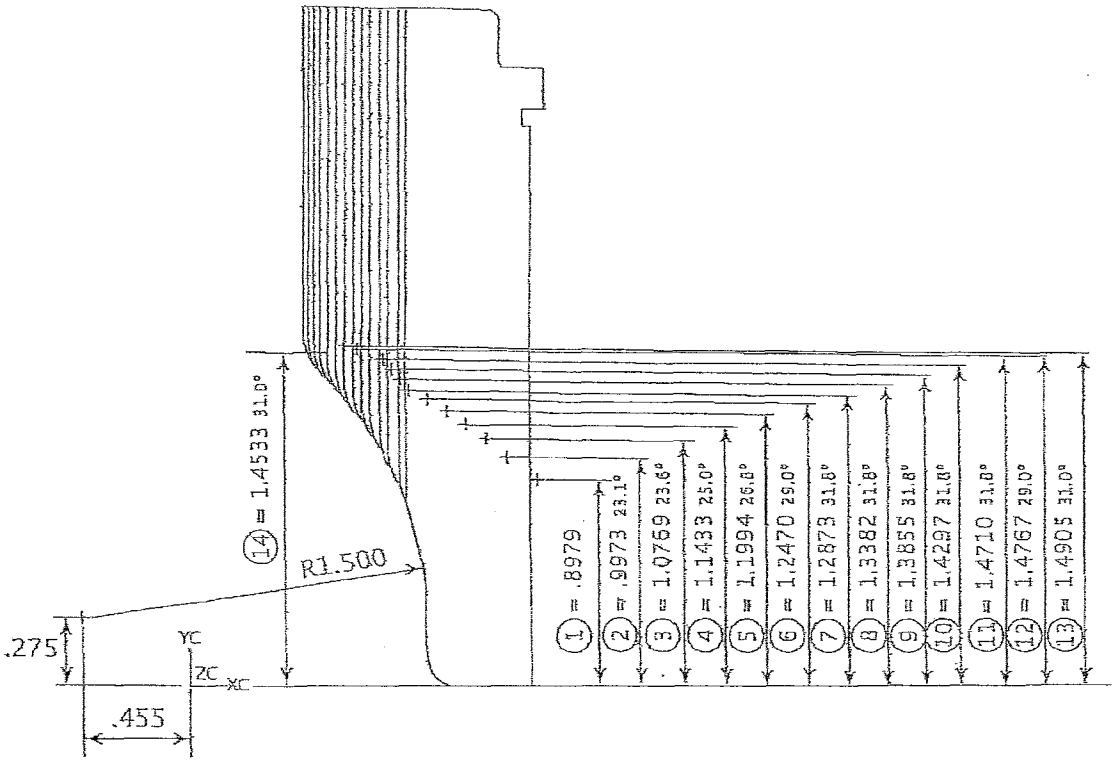
FIG. 7 shows a cross-sectional side view for the shoulder necking surface of each necking die in a 14 stage necking system, in accordance with the present invention.

As depicted in Table 1 the necking system includes a first necking die that provides a reduction of approximately 9%, 12 intermediate dies having a reduction ranging from approximately 4.1 to 6.1%, and a final necking die having a reduction of 1.9%. FIG. 7 represents a cross-sectional side view for the shoulder necking surface of each necking die of the 14 stage necking system represented in Table 1. In this example, the portion of the bottle stock being necked has a substantially uniform thickness.

Figure 8:
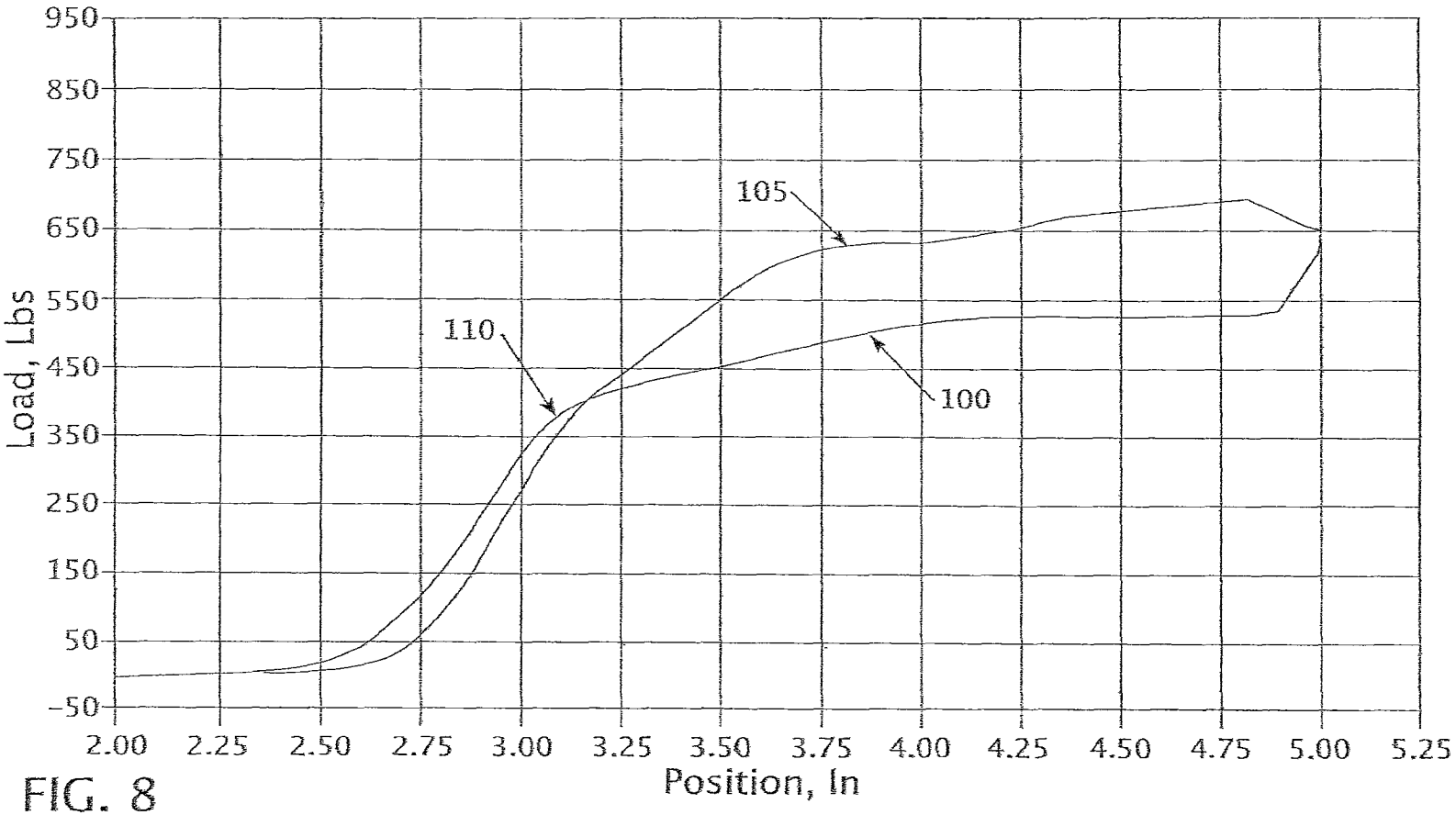
FIG. 8 PRIOR ART
FIG. 8 is a plot of the necking force required to neck an aluminum bottle into a partially non-polished necking die and the force required to neck a bottle into a polished necking die, wherein the y-axis represents force in pounds (lbs) and the x-axis represents the distance (inches) in which the bottle is inserted into the necking die.
Figure 9:
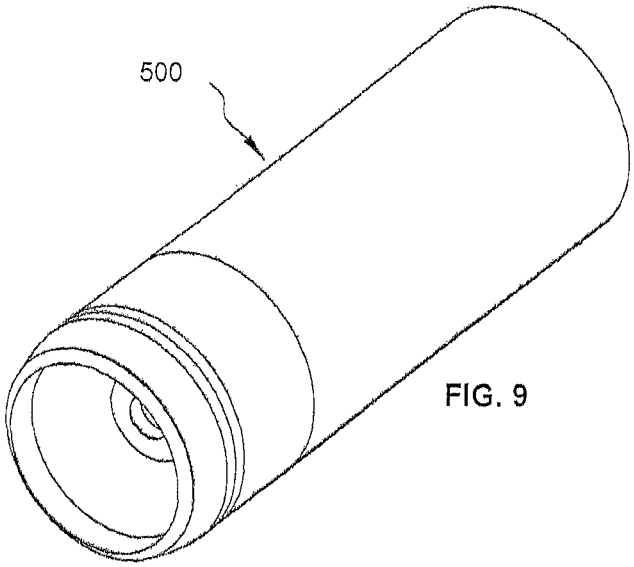
FIG. 9 is a perspective view of one embodiment of an expansion die used to expand a 2.087" diameter container to a 2.247" diameter container, in accordance with one embodiment of the present invention.
Figure 10:
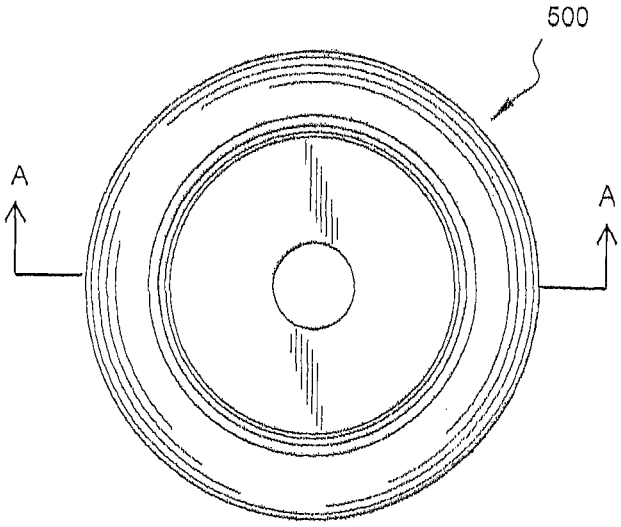
FIG. 10 PRIOR ART
FIG. 10 is a top view of the expansion die of FIG. 9 showing line A-A.
Figure 11:
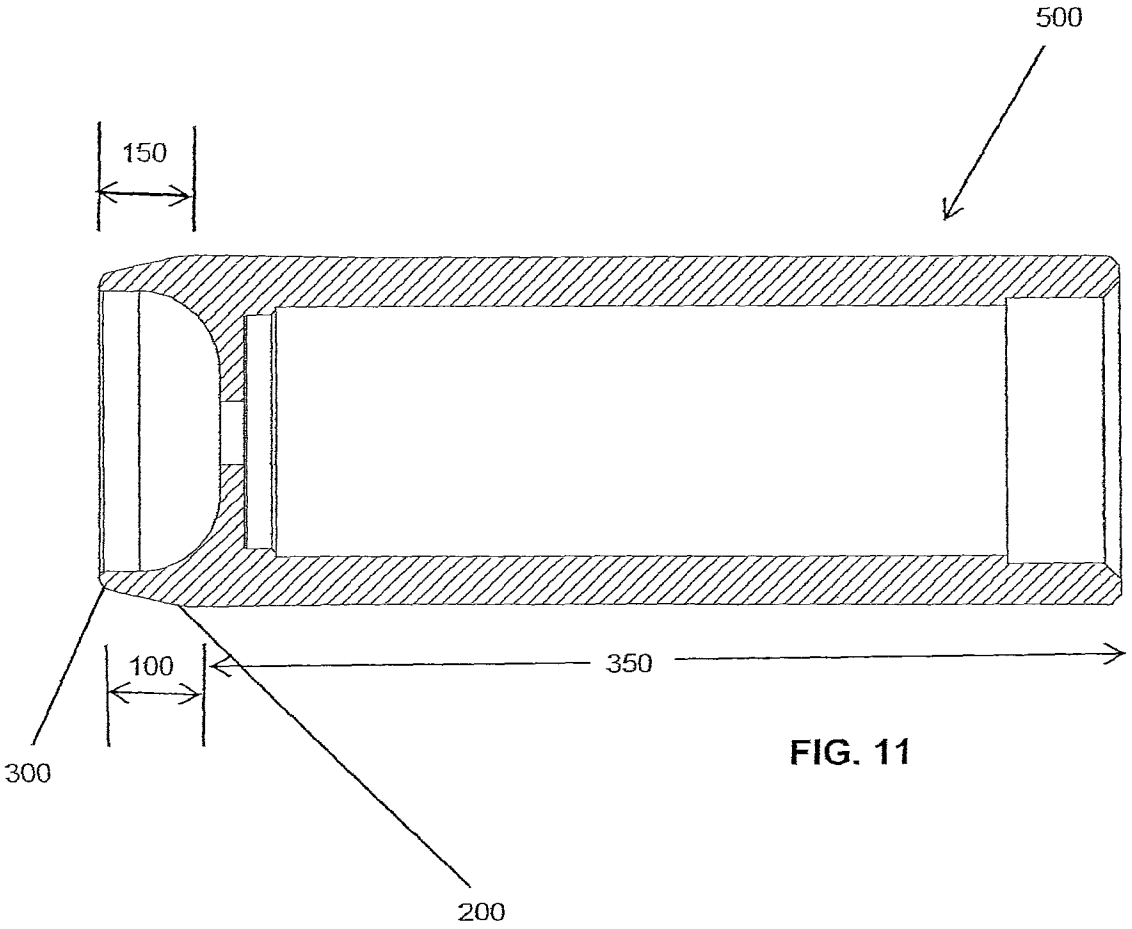
FIG. 11 PRIOR ART
FIG. 11 is a cross-sectional view of the expansion die of FIGS. 9 and 10 along line A-A.
Figure 12:
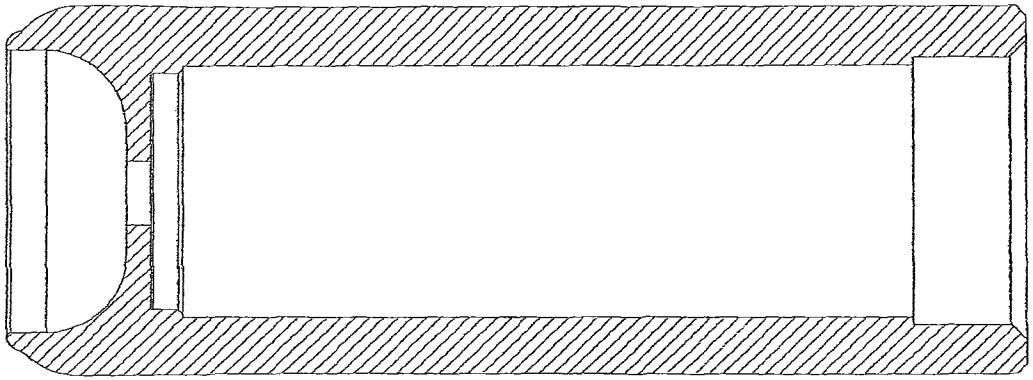
FIG. 12 PRIOR ART
FIG. 12 is a cross-sectional view of an expansion die used to expand a 2.247" diameter container to a 2.363" diameter container according to one embodiment of the invention.
Figure 13:
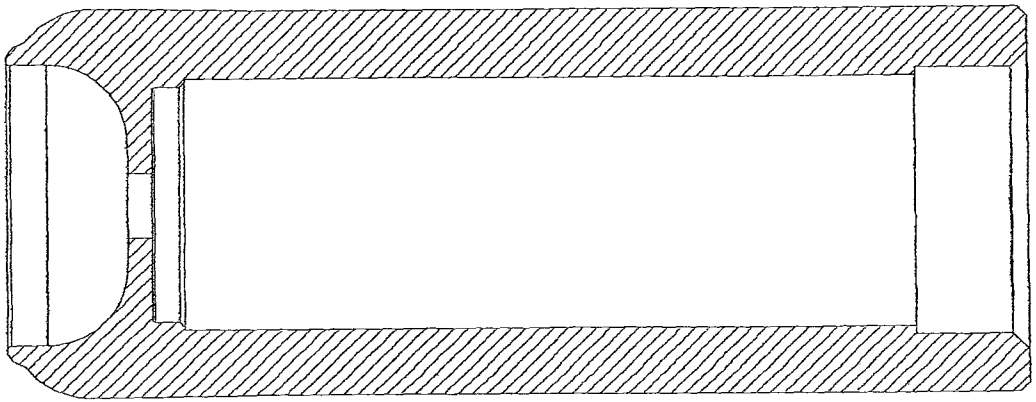
FIG. 13 PRIOR ART
FIG. 13 is a cross-sectional view of an expansion die which can be used to expand a 2.363" diameter container to a 2.479" diameter container.
Figure 14:
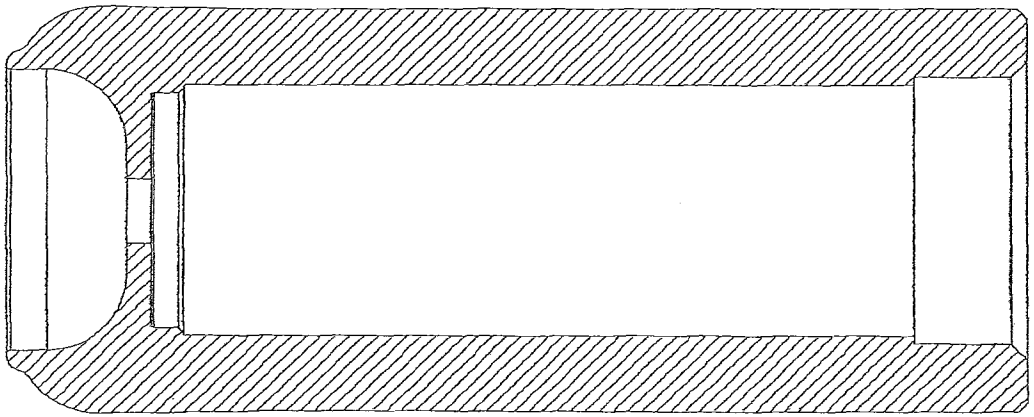
FIG. 14 PRIOR ART
FIG. 14 is a cross-sectional view of an expansion die which can be used to expand a 2.479" diameter container to a 2.595" diameter container.
Figure 15:
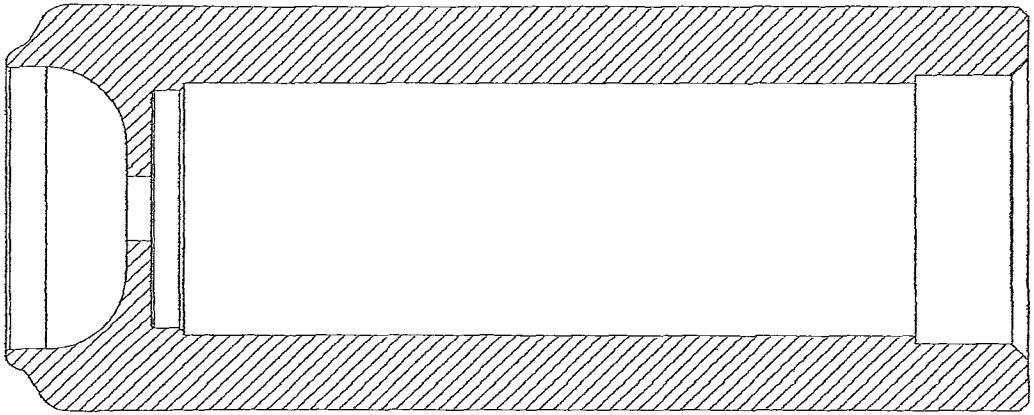
FIG. 15 PRIOR ART
FIG. 15 is a cross-sectional view of a die which can be used to set the shape of the lower profile.

FIG. 8 depicts the force required to neck a bottle into a necking die having a textured land in accordance with the invention, as indicated by reference line 100, and the force required to neck an aluminum container into a non-textured necking die, as indicated by reference line 105, wherein the non-textured necking die represents a comparative example. The geometry of the necking die having the textured land and the control die is similar to the necking die depicted in FIG. 2. The bottle being necked had an upper sidewall sheet thickness of approximately 0.0085 inch, a post bake yield strength of approximately 34 to 37 ksi, and an aluminum composition being Aluminum Association 3104.

Referring to FIG. 8, a significant decrease in the necking force is realized beginning at the point in which the bottle being necked contacts the textured land, as illustrated by data point 110 on the reference line 100, as compared to a non-textured necking surface, depicted by reference line 105.

Now turning to the expansion die, a gradual expansion of a container comprised of a hard temper alloy using multiple expansion dies of increasing diameters, as opposed to using one expansion die, allows the diameter of the container to be expanded up to about 40% without fracturing, wrinkling, buckling or otherwise damaging the metal comprising the container. When expanding a container constructed of a softer alloy, it may be possible to expand the container 25% using one expansion die. The number of expansion dies used to expand a container to a desired diameter without significantly damaging the container is dependent on the degree of expansion desired, the material of the container, the hardness of the material of the container, and the sidewall thickness of the container. For example, the higher the degree of expansion desired, the larger the number of expansion dies required. Similarly, if the metal comprising the container has a hard temper, a larger number of expansion dies will be required as compared to expanding a container comprised of a softer metal the same degree. Also, the thinner the sidewall, the greater number of expansion dies will be required. Progressive expansion using a series of expansion dies may provide increases in the container's diameter on the order of 25%, wherein greater expansions have been contemplated, so long as the metal is not significantly damaged during expansion. In some embodiments, the diameter of the container is expanded more than 8%. In other embodiments the diameter of the container is expanded less than 8%, greater than 10%, greater than 15%, greater than 20%, greater than 25%, or greater than 40%. Other percentages of expansion are contemplated and are within the scope of some embodiments of the invention.

Further, when expanding a coated container, a gradual expansion will help to maintain the integrity of the coating. Alternatively, a container may be expanded before coating.

Necking an expanded container formed in accordance with some embodiments of the invention to a diameter greater than or equal to the container's original diameter X does not require the use of a knockout because the container's sidewall is in a state of circumferential tension following expansion. In some embodiments of the invention, a knockout can be used when necking the container.

Referring to FIGS. 9-16, in some embodiments, the expansion die is comprised of A2 tool steel, 58-60 Rc harden, 32 finish, although any suitable container shaping die material may be used. In some embodiments, the expansion die 500 includes a work surface 100, having a progressively expanding portion 150, a land portion 200, and an undercut portion 350. An initial portion 300 of the work surface 100 in the depicted embodiment has a geometry for gradually transitioning the diameter of the container 700 sidewall 800. The progressively expanding portion 150 has dimensions and a geometry that when inserted into the open end of a container 700 works the container's sidewall 800 to radially expand the container's diameter in a progressive manner as the container travels along the work surface 100. In some embodiments, the expansion die 500 provides the appropriate expansion and forming operations without the need of a knockout or like structure. In some embodiments, a knockout may be used.

The land portion 200 has dimensions and a geometry for setting the final diameter of the container being formed by that expansion die 500. In one embodiment, the land portion 200 may extend a distance of 0.12" or more. In other embodiments, the land may extend 0.010", 0.020", 0.04", 0.05, 0.08 or 0.10 or more or less. An undercut portion 350 follows the land portion 200. The transition from the land portion 200 to the undercut portion 350 is blended. The undercut portion 350 extends at least beyond the opening of the container when the die is at the bottom of the expansion stroke to enable the die to maintain control of the metal as it expands and to minimize the container becoming out-of-round.

The work surface 100 may be a non-textured surface or a textured surface. In one embodiment, a non-textured surface has a surface roughness average (Ra) finish ranging from 2 μin to 6 μin. In one embodiment, the work surface 100 may be a textured surface having a surface roughness average (Ra) ranging from more than or equal to 8 μin to less than or equal to 32 μin, so long as the textured work surface 100 does not significantly degrade the product side coating disposed along the container's inner surface.

In some embodiments, immediately following the land portion 200 the surface of the expansion die transitions smoothly to an undercut portion 350 in order to reduce, but not eliminate, the frictional contact between the container 700 and the expansion die 500 as the container is worked through the progressively expanding portion 150 and land portion 200 of the work surface 100. The reduced frictional contact minimizes the incidence of collapse, buckling, rupturing, wrinkling and other physical defects, and improves stripping of the container 700 during the expansion process. In some embodiments, the undercut portion 350 is a textured surface having a surface roughness average (Ra) ranging from more than or equal to 8 μin to less than or equal to 32 μin. In some embodiments, the undercut portion 350 may extend into the expansion die wall by a dimension L of at least 0.005 inches, in other embodiments, at least 0.015 inches or 0.025". In some embodiments, the undercut portion extends into the die wall no more than 0.025".

A die system for producing containers is provided including the expansion die 500. The die system includes at least a first expansion die 500 having a work surface 100 configured to increase a container's diameter, and at least one progressive expansion die, wherein each successive die in the series of progressive expansion dies has a work surface configured to provide an increasing degree of expansion in the container's diameter from the previous expansion die. In one embodiment, the die system may also include one or more necking dies.

Although the invention has been described generally above, the following example is provided to further illustrate the present invention and demonstrate some advantages that may arise therefrom. It is not intended that the invention be limited to the specific example disclosed.

Figure 16:
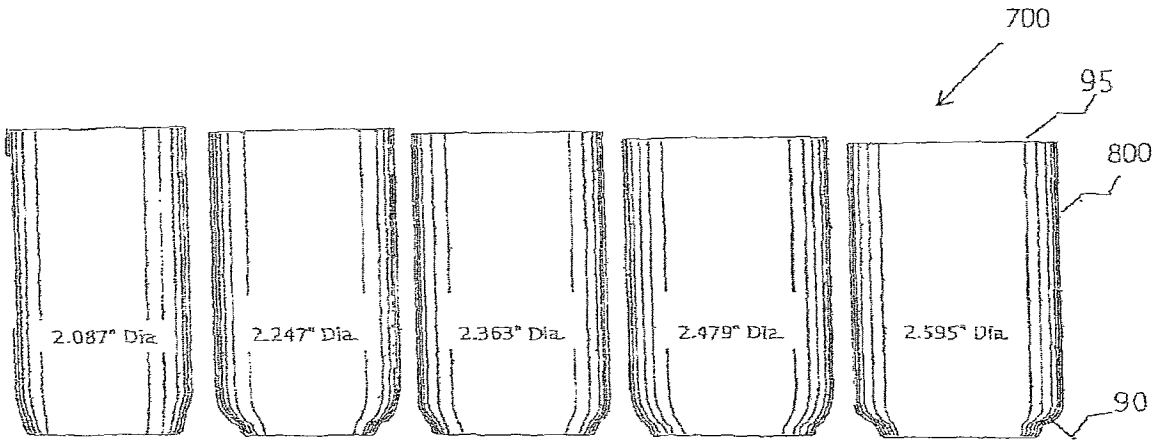
FIG. 16 PRIOR ART
FIG. 16 is a side view of five containers, wherein each container represents one stage of expansion of a 2.087" diameter container to a 2.595" diameter container according to one embodiment of the invention.
Figure 17:
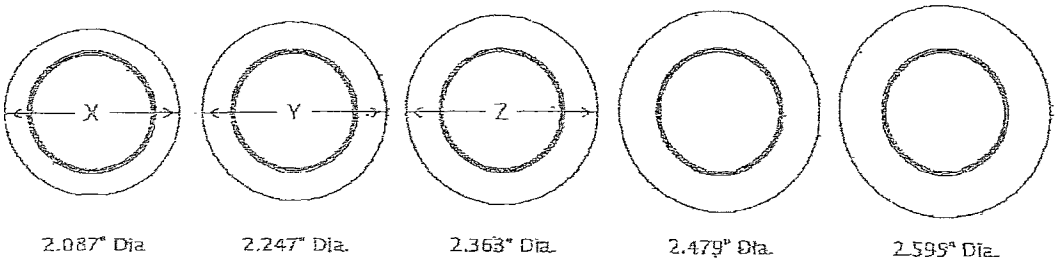
FIG. 17 is a top view of the five containers of FIG. 16.
Figure 18:
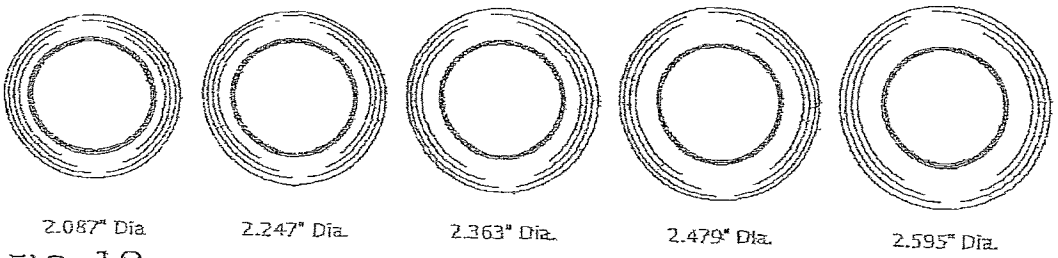
FIG. 18 PRIOR ART
FIG. 18 is a bottom view of the five containers of FIG. 16.

In one example, the four expansion dies depicted in FIGS. 11-14 are utilized to increase the internal diameter of the container 700 from about 2.087" to a diameter of about 2.595", as depicted in FIGS. 16-18. The expansion die 500 depicted in FIGS. 9-11 can be used to expand the 2.087" diameter container to a 2.247" diameter container. The expansion die shown in FIG. 12 can be used to expand the 2.247" diameter container to a 2.363" diameter container. The expansion die shown in FIG. 13 can be used to expand the 2.363" diameter container to a 2.479" diameter container. The expansion die shown in FIG. 14 can be used to expand the 2.479" diameter container to a 2.595" diameter container. It should be noted that as the diameter of the container expands, it also becomes shorter.

In one embodiment, the containers of FIGS. 16-18 are comprised of 3104 aluminum alloy having a H19 temper.

The sidewall thickness is about 0.0088". It should be noted that using some embodiments of the invention, it is possible to expand thin walled (equal to or less than about 0.0041"), hard-temper (H19, H39) drawn and ironed aluminum cans varying amounts including expanding these containers greater than 8% in diameter, greater than 10%, greater than, 15%, and greater than 20%.

Figure 19:
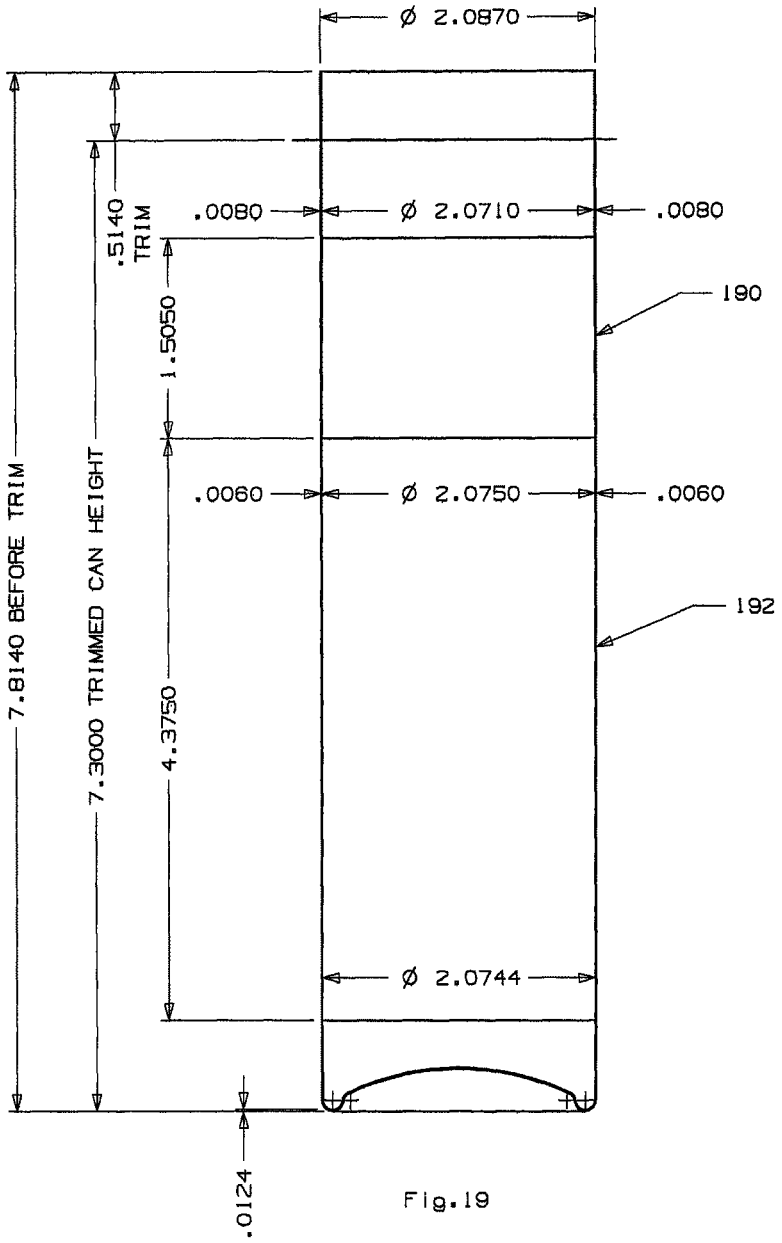
FIG. 19 is a cross-section view of a metal container having a sidewall of varying thickness.

In one example FIG. 19, shows a container 190 having a sidewall 192 with a thickness that varies between about 0.006" and about 0.008". The container 190 is aluminum in this example but may be comprised of any metal, such as steel, for example.

Figure 20:
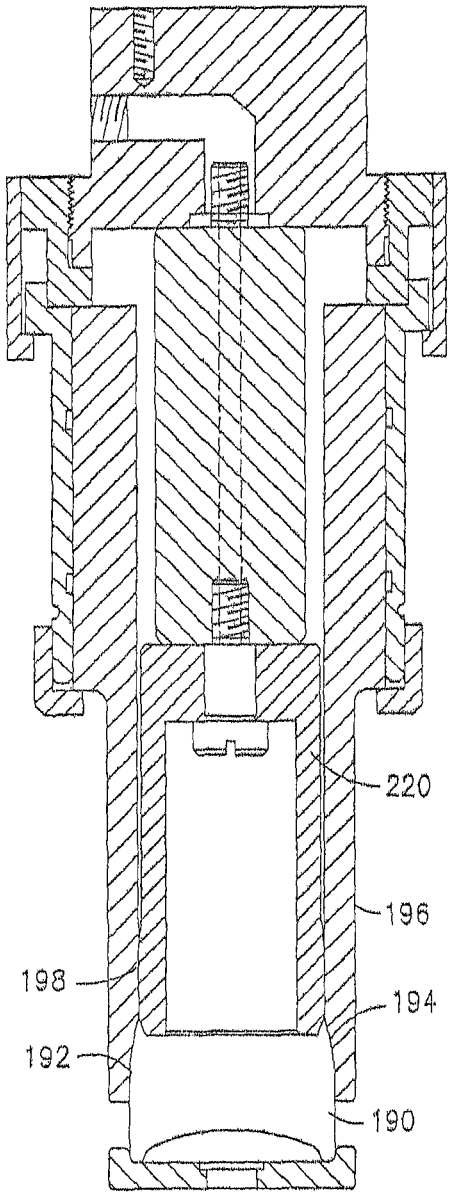
FIG. 20 is a cross-section view of a necking die necking a lower portion of the sidewall of the metal container shown in FIG. 19.

FIG. 20 shows a necking die 196 necking a lower portion 194 of the sidewall 192. A bottom necked portion 198 is also illustrated as well as a knockout 220.

Figure 21:
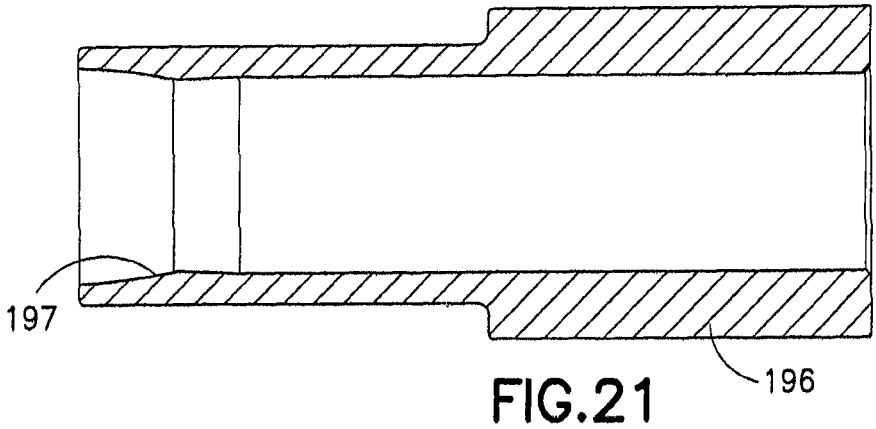
FIG. 21 shows a cross-section view of the necking die in FIG. 20.
Figure 21A:
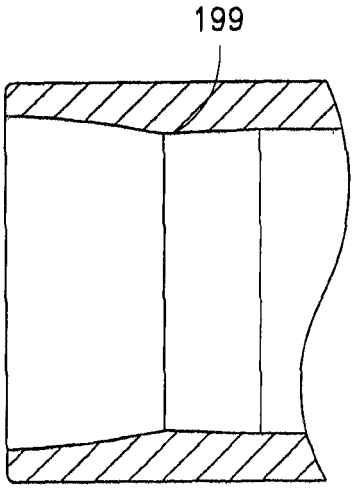
FIG. 21*a* is a partial cross-section view of the nose of the necking die shown in FIGS. 20 and 21.

FIGS. 21 and 21*a* show a necking die 196, shown in FIG. 20, representing a series of two necking dies used to create the bottom necked portion 198 of the container 190. The table shown next to FIGS. 21 and 21*a* show the dimensions that vary between the first and second dies, which comprise the series of two dies used to form the bottom necked portion 198 (shown in FIGS. 20 and 25) of the container 190. Part of the working surface 197 of the necking die 196, including the land 199 has a textured surface with an Ra value of about 12 micro inches. The Ra value of the working surface 197 that was not textured had a Ra value of about 8-10 micro inches.

Figure 22:
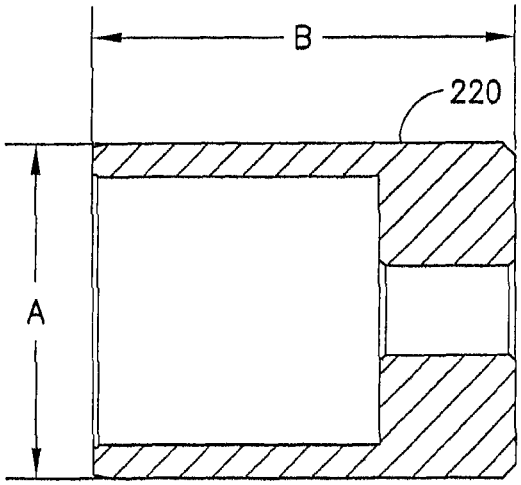
FIG. 22 shows a cross-section of a knockout used in conjunction with the necking die in FIGS. 20, 21 and 21*a;*

FIG. 22 shows a knockout 220 representative of the two knockouts used in conjunction with the necking dies 196 shown in FIGS. 20, 21 and 21*a*. The table below shows the dimensions that vary between the first and second knockouts 220, which were used with the series of two dies to form the bottom necked portion 198 of the container 190,

| ITEM # | ϕ'A' | 'B' DIM. |
|---|---|---|
| 01 | 1.9456 | 4.045 |
| 02 | ⚠ 1.8664 | 3.744 |

The table below shows the dimensions of the container 190 before and after each necking step in necking the lower portion 194 of the sidewall 192.

| station | start dia. | reduction | final dia. | knockout diameter | gap | estimated metal thk | % reduction |
|---|---|---|---|---|---|---|---|
| bottom | | | | | | 0.0080 | |
| necking | | | | | | | |
| 1 | 2.088 | 0.125 | 1.963 | 1.9450 | 0.0090 | 0.0083 | 5.99 |
| 2 | 1.963 | 0.079 | 1.884 | 1.8660 | 0.0090 | 0.0085 | 4.02 |

The dimensions are in inches. The "gap" is the radial distance between the inner diameter of the land 199 of the necking dies 196 and the outer diameter of knockouts 220. The "estimated metal thk" is the maximum thickness of the metal being formed by the necking die. As mentioned earlier, the metal thickness of the sidewall 192 of the containers formed in this example varies by about 0.002" in the portion of the sidewall 192 being formed, i.e. the necking dies 196 travel over metal that varies in thickness by about 0.002". The necking dies 196 and the accompanying knockouts 220 are designed to accommodate the thickest metal, as well as the thinnest metal they pass over in the necking process. The thickest metal in the sidewall 192, in this example, is near the top of the container 190. This information also applies to tables appearing later in this specification.

Figure 23:
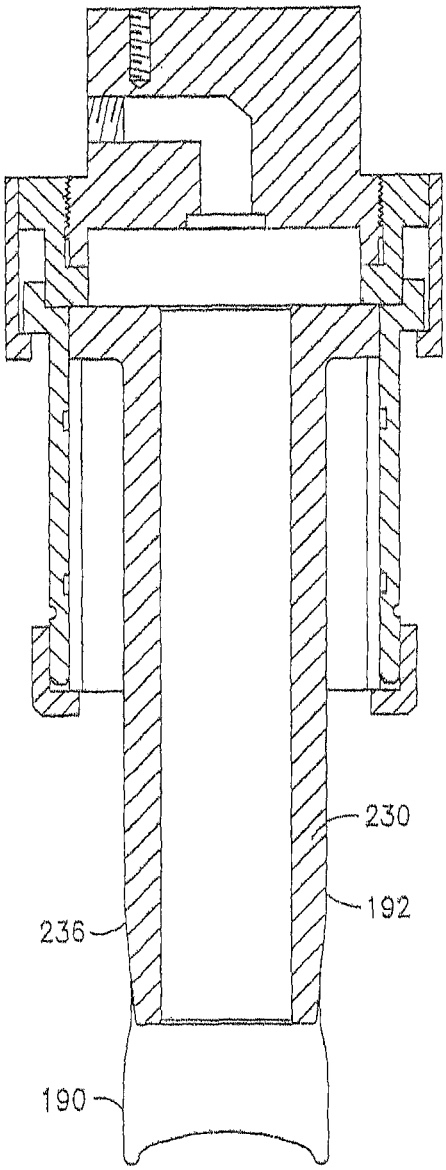
FIG. 23 is a cross-section view of an expansion die expanding a middle portion of the sidewall of the metal container shown in FIG. 19.
Figure 24:
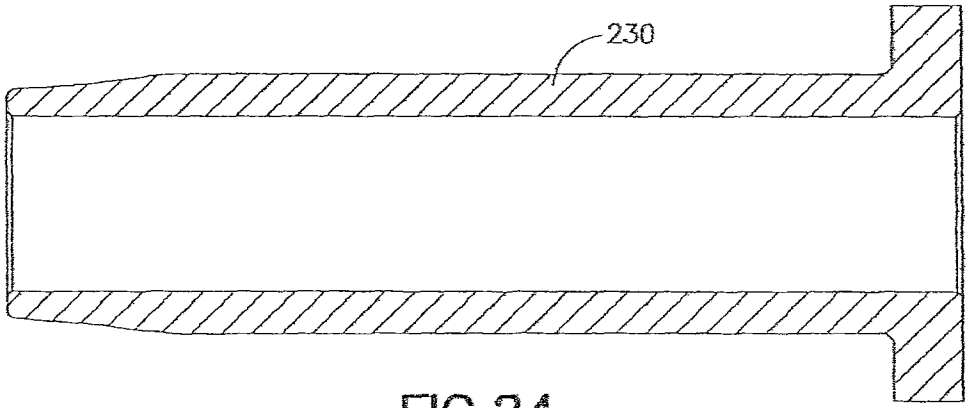
FIG. 24 shows a cross-section view of the expansion die in FIG. 23.

FIGS. 23 and 24 show an expansion die 230 used to expand the diameter of a middle portion 236 of the sidewall 192 of the container 190 after the two necking steps. In this example, two expansion steps followed the two necking steps. The table shown under FIG. 24 shows the dimensions that vary between the first and second expansion dies 230, which comprise a series of two expansion dies. None of the expansion dies 230 were textured in this example.

In the table below, "body rad." and "neck rad." refer to radii of the expansion dies.

| station | start dia. bottom expansion | expansion | final dia. | body rad. | neck rad. | estimated metal thk | % expansion % expansion |
|---|---|---|---|---|---|---|---|
| 1 | 1.884 | 0.158 | 2.042 | 14.000 | 0.500 | 0.0081 | 8.39 |
| 2 | 2.042 | 0.040 | 2.082 | 14.000 | 0.500 | 0.0080 | 1.96 |

Figure 25:
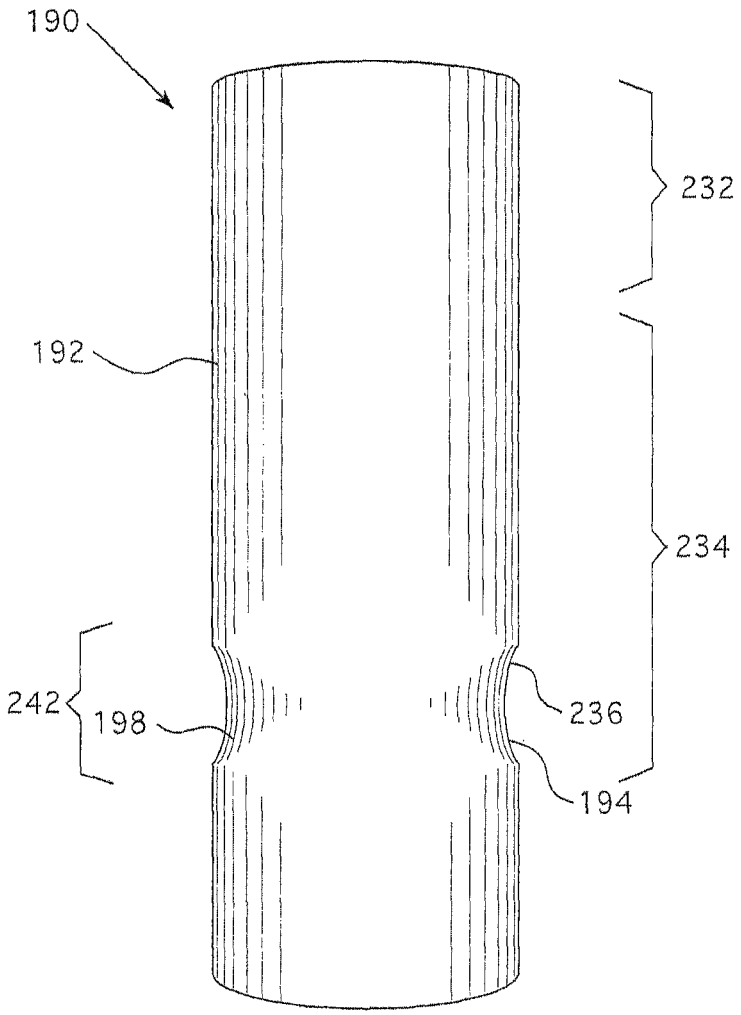
FIG. 25 depicts a metal container after a lower portion has been necked and a middle portion has been expanded.

FIG. 25 shows the container after necking with the two necking dies shown in FIGS. 20, 21 and 21*a* and expanding with the two expansion dies shown in FIGS. 23 and 24. The thin wall portion 234 and thick wall portion 232 are shown. The transition between the thin wall and the thick wall can be short or long and gradual. The necking steps followed by expansion steps form a pinch 242 in the container 190.

Figure 26:
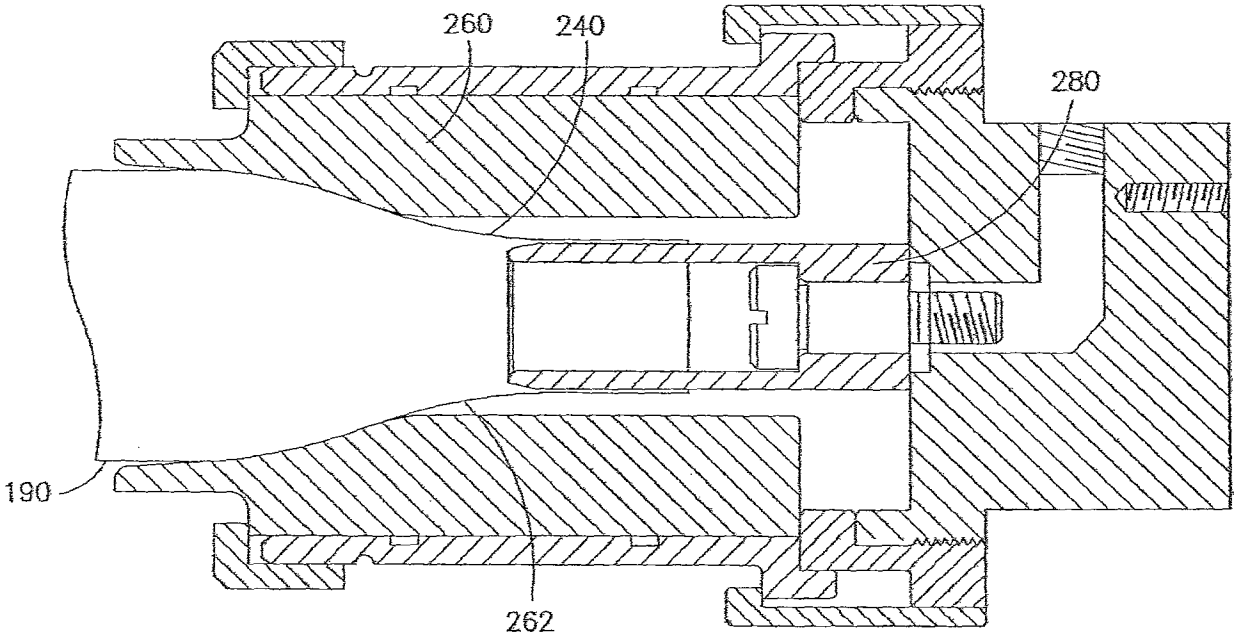
FIG. 26 shows a cross-section view of a necking die, which may be used to neck an upper portion of the sidewall of the metal container shown in FIG. 19.
Figure 27:
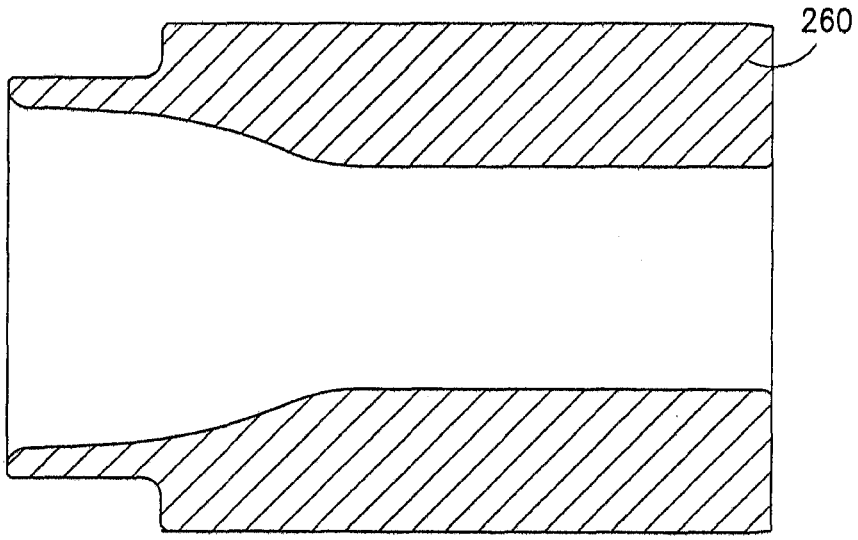
FIG. 27 shows a cross-section view of a necking die, which may be used to neck an upper portion of the sidewall of the metal container shown in FIG. 19.

FIG. 26 shows a necking die 260 forming the top necked portion 262 in an upper portion 240 of the container 190. Because of the scale of the drawing, the land and relief in the necking die is not shown. The top necked portion 262 was necked in multiple necking stations with a series of multiple different necking dies. Additional necking stations and dies may be used to obtain a bottle or other desired shape. A die representative of the five dies used in stations 1-5 is shown in FIG. 27. The dimensions that vary between each of the five dies used to produce the top necked portion are shown in the table below.

| DIE # | ϕ'A' ±.0002 | 'B' RAD. ±.005 | 'C' RAD ±.005 | 'D' DIM (REF) |
|---|---|---|---|---|
| 01 | 2.0050 | 2.950 | 1.000 | .5711 |
| 02 | 1.9550 | 3.000 | 1.000 | .7263 |
| 03 | 1.9100 | 3.050 | 1.00 | .6444 |
| 04 | 1.8650 | 3.100 | 1.000 | .9457 |
| 05 | 1.8300 | 3.150 | 1.000 | 1.0461 |

Figure 28:
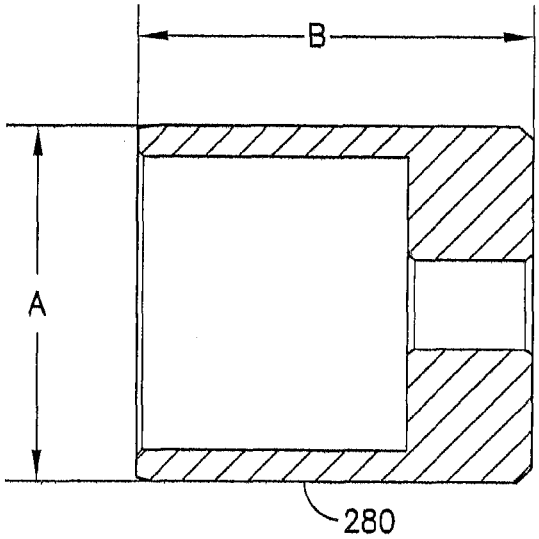
FIG. 28 shows a cross-section of a knockout used in conjunction with the necking die in FIG. 27.

None of the dies in this series of five were textured. FIG. 28 shows a knockout 280 representing the knockouts used in conjunction with the five necking dies represented in FIG. 27. The table below lists the dimensions that vary between the five knockouts 280.

| ITEM # | ϕ'A' | 'B' DIM. | ϕ'C' |
|---|---|---|---|
| 01 | 1.9880 | 4.689 | 1.25 |
| 02 | 1.9378 | 4.534 | 1.25 |
| 03 | 1.8926 | 4.416 | 1.25 |
| 04 | 1.8474 | 4.310 | 1.25 |
| 05 | 1.8022 | 4.214 | 1.25 |

In this example, the outer diameter of the top of the container before necking was about 53 mm (2.087 inches).

| station | start dia. top necking | reduction | final dia. | body rad. | neck rad. | knockout diameter | gap | estimated metal thk | % reduction |
|---|---|---|---|---|---|---|---|---|---|
| 1 | 2.087 | 0.082 | 2.005 | 2.950 | 1.000 | 1.9884 | 0.0083 | 0.0082 | 3.93 |
| 2 | 2.005 | 0.050 | 1.955 | 3.000 | 1.000 | 1.9382 | 0.0084 | 0.0083 | 2.49 |
| 3 | 1.955 | 0.045 | 1.910 | 3.050 | 1.000 | 1.8930 | 0.0085 | 0.0084 | 2.30 |
| 4 | 1.910 | 0.045 | 1.865 | 3.100 | 1.000 | 1.8480 | 0.0085 | 0.0085 | 2.36 |
| 5 | 1.865 | 0.045 | 1.820 | 3.150 | 1.000 | 1.8022 | 0.0089 | 0.0087 | 2.41 |

Having described the presently preferred embodiments, it is to be understood that the invention may be otherwise embodied within the scope of the appended claims.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

The invention claimed is:

1. A process for forming a metal container comprising:

providing a container having a sidewall, wherein the sidewall has a thickness, a thinnest portion, and a height, and wherein the thickness varies along the height of the sidewall by at least 0.001 inches; and necking the container with a necking die so that a working surface of the necking die contacts a section of the sidewall and reduces a diameter of the section of the sidewall by at least 2% in a single stroke, wherein the thickness of the section of the sidewall being necked varies along the height of the sidewall by at least 0.001 inches at locations which directly contact the necking die before and after necking, wherein the section of the sidewall being necked includes the thinnest portion of the sidewall.

2. The process of claim 1 wherein the necking die comprises:

a necking surface and a relief;

wherein the necking surface comprises a land portion, a neck radius portion, and a shoulder radius portion, each having an inner diameter;

wherein the land portion is between the neck radius portion and the relief and the inner diameter of the land is a minimum diameter of the die;

wherein the inner diameters of the neck radius portion and the shoulder radius portion are greater than the inner diameter of the land;

wherein the relief comprises:

(a) a relief surface;

(b) an inner diameter of the relief surface is at least about 0.01 inches greater than the inner diameter of the land portion;

(c) an inner diameter of the relief surface is no greater than a maximum diameter so as to reduce but not eliminate frictional contact between the metal container and the relief surface while maintaining necking performance when necking the metal container; and wherein the necking die is dimensioned so that when necking the metal container, the entire land and the relief travel relative to the container in an axial direction and at least a portion of the relief travels beyond a top of the container.

3. The process of claim 1 further comprising expanding the diameter of a portion of the sidewall.

4. The process of claim 3 wherein an expansion die expands the portion of the sidewall, wherein the expansion die comprises:

a work surface comprising a progressively expanding portion and a land portion; and an undercut portion;

wherein the land portion is between the progressively expanding portion and the undercut portion and an outer diameter of the land portion is a maximum diameter of the die;

wherein the undercut portion comprises:

(a) an undercut surface; and (b) an outer diameter of the undercut surface, wherein the outer diameter of the undercut surface is:

(i) at least approximately 0.01 inches smaller than the outer diameter of the land portion; and (ii) no less than a minimum diameter so as to reduce but not eliminate frictional contact between the undercut surface and the metal container; and wherein the work surface is dimensioned so that when inserted into the metal container the entire land portion and at least a portion of the undercut portion enter the metal container causing the diameter of the at least a portion of the sidewall to expand.

5. The process of claim 1 further comprising necking the container with a series of necking dies.

6. The process of claim 1 further comprising expanding the diameter of the portion of the sidewall with a series of expansion dies.

7. The process of claim 1 wherein the thickness of the section of the sidewall being necked varies along the height of the sidewall by at least 0.0015 inches.

8. The process of claim 1 wherein the thickness of the section of the sidewall being necked varies along the height of the sidewall by at least 0.002 inches.

9. A process for forming a metal container comprising:

providing a container having a sidewall, wherein the sidewall has a variable thickness between 0.005 inches and 0.0085 inches, a thinnest portion, and a height, and wherein the thickness varies along the height of the sidewall by at least 0.001 inches to not greater than 0.004 inches; and necking the container with a necking die so that a working surface of the necking die contacts a section of the sidewall and reduces a diameter of the section of the sidewall by at least 2% in a single stroke, wherein the thickness of the section of the sidewall being necked varies along the height of the sidewall by at least 0.001 inches to not greater than 0.004 inches at locations which directly contact the necking die before and after necking, wherein the section of the sidewall being necked includes the thinnest portion of the sidewall.

* * * * *